US012345497B1

(12) United States Patent
Clark et al.

(10) Patent No.: US 12,345,497 B1
(45) Date of Patent: Jul. 1, 2025

(54) HIGH-PRESSURE AIR DRUM MAGAZINE FOR BELT FED WEAPON

(71) Applicant: VirTra, Inc., Tempe, AZ (US)

(72) Inventors: Douglas R. Clark, Phoenix, AZ (US); John B. Kinnard, Mesa, AZ (US); Mitchell Hillis, Scottsdale, AZ (US); Stephen D. Handel, Gilbert, AZ (US)

(73) Assignee: VirTra, Inc., Tempe, AZ (US)

( * ) Notice: Subject to any disclaimer, the term of this patent is extended or adjusted under 35 U.S.C. 154(b) by 993 days.

(21) Appl. No.: 17/402,449

(22) Filed: Aug. 13, 2021

Related U.S. Application Data

(60) Provisional application No. 63/065,211, filed on Aug. 13, 2020.

(51) Int. Cl.
*F41A 9/34* (2006.01)
*F41A 33/06* (2006.01)
*F41A 9/50* (2006.01)

(52) U.S. Cl.
CPC ..... *F41A 9/34* (2013.01); *F41A 33/06* (2013.01); *F41A 9/50* (2013.01)

(58) Field of Classification Search
CPC ..... F41A 9/34; F41A 33/06
See application file for complete search history.

(56) References Cited

U.S. PATENT DOCUMENTS 8,827,706 B2 9/2014 Hogan, Jr.
10,436,539 B2 10/2019 Tiberius et al.
2009/0084015 A1* 4/2009 Compton ..... F41A 19/01 42/1.02

(Continued)

FOREIGN PATENT DOCUMENTS

DE 102013225966 6/2015
DE 102015211619 A1 * 12/2016 ..... F41A 33/06

(Continued)

OTHER PUBLICATIONS

Tomáš Lukáč, Roman Vítek, Linh Do Duc, Vladimír Horák, Experimental Mechanical Device for Recoil Simulation, Scientific Research and Education in the Air Force—AFASES, pp. 337-344, 2016, Czech Republic.

(Continued)

*Primary Examiner* — Dmitry Suhol
*Assistant Examiner* — Jose Angeles
(74) *Attorney, Agent, or Firm* — Kenneth C. Booth; Booth Udall, PLC

(57) ABSTRACT

A tether-less recoil kit for a weapon having a trigger with a receiver insert, an air connector plate, and a high-pressure air drum magazine. The receiver insert is configured for attachment to a receiver of a weapon and has a charge chamber and a bolt carrier. The charge chamber has a plunger extending through a rear end of the charge chamber and an air-receiving nipple configured to receive air into the charge chamber. The air connector plate fluidly couples the high-pressure air drum magazine to the receiver insert. The high-pressure air drum magazine has a high-pressure chamber within an outer housing and an air regulator configured to selectively pass air from the high-pressure chamber to the air connector plate. When the bolt carrier impacts the plunger, a burst of air may be released from the air connector plate into the charge chamber.

19 Claims, 20 Drawing Sheets

(56) References Cited

U.S. PATENT DOCUMENTS

| | | | | |
|---|---|---|---|---|
| 2012/0129136 | A1 | 5/2012 | Dvorak | |
| 2018/0087860 | A1* | 3/2018 | Sullivan | F41A 19/17 |
| 2018/0180377 | A1* | 6/2018 | Lort | F41B 11/62 |

FOREIGN PATENT DOCUMENTS

| | | |
|---|---|---|
| DE | 102015211621 | 12/2016 |
| EP | 3296680 | 3/2018 |
| KR | 102093831 B1 * | 3/2020 |

OTHER PUBLICATIONS

Military Recoil Weapons and Conversion Kits https://www.lasershot.com/item/158-recoil-conversion-kits.

* cited by examiner

HIGH-PRESSURE AIR DRUM MAGAZINE FOR BELT FED WEAPON

CROSS REFERENCE TO RELATED APPLICATIONS

This application claims the benefit of the filing date of U.S. Provisional Patent Application 63/065,211 entitled "High-pressure Air Magazine for Belt Fed Light Machine Gun" to Douglas R. Clark, et. al., that was filed on Aug. 13, 2020, the disclosure of which is hereby incorporated herein by this reference.

TECHNICAL FIELD

Aspects of this document relate generally to a recoil kit for a weapon, and more specifically to a tether-less, air-pressured recoil kit for a belt-fed weapon.

BACKGROUND

There is a need for effective training for law enforcement, security officers and military. One aspect of effective training that is lacking is the ability to practice using firearms during simulation activities that feel and behave the same way as during live situations but are safe for those involved in the simulation. For example, because it is unsafe for trainees to fire live rounds during training activities, it is difficult to create an experience for them to practice responding to specific situations where the firearm responds in the same way as it would in real life. Some simulation systems have involved connecting a firearm to a pressurized tank so that the pressurized tank can provide a simulated recoil. However, this both allows the firearm to "fire" as many times as the user desires and causes the firearm to be used differently than it otherwise would, because it must be physically attached to the tank. These limitations interfere with the effectiveness of the simulation as a training activity.

SUMMARY

Aspects of this document relate to a tether-less, air-pressured recoil kit for a weapon having a trigger, the recoil kit comprising a receiver insert configured for attachment to a receiver of a belt-fed weapon, the receiver insert comprising a charge chamber comprising a biased plunger extending through a rear end of the charge chamber and an air-receiving nipple on a side of the charge chamber configured to receive air into the charge chamber, the biased plunger biased rearward toward the rear end and moveable between a forward position and a rearward position, and a bolt carrier configured to respond to the trigger being activated on the weapon to move the plunger from its rearward position toward its forward position, an air connector plate comprising a seal and configured to sealingly engage with the air-receiving nipple of the charge chamber and become locked in place between the charge chamber and a feed cover of the weapon when the feed cover is locked in a closed position, and a high-pressure air drum magazine comprising an outer housing formed of aluminum and configured to connect to a bottom side of the weapon, the high-pressure air drum magazine coupled through a flexible air passage to the air connector plate, a high-pressure chamber formed within the outer housing and sized to hold a predetermined quantity of pressurized air, a chamber plug sealingly coupled to a first end of the high-pressure air chamber, a fill valve disposed between the high-pressure chamber and a fill port exposed on a surface of the outer housing, the fill port configured to couple with a high-pressure nozzle to admit pressurized air into the high-pressure chamber, an air regulator communicatively coupled to the high-pressure chamber within the outer housing and configured to selectively pass air from the high-pressure chamber through a low-pressure chamber within the outer housing and to the air connector plate, the air regulator comprising a regulator ball valve positioned between the high-pressure chamber and the low-pressure chamber, the regulator ball valve biased by a compression spring to a closed position wherein airflow from the high-pressure chamber to the low-pressure chamber is minimized, a regulator valve screw exposed on the surface of the outer housing and configured to adjust a magnitude of a bias on the regulator ball valve created by the compression spring, a regulator piston exposed to the low-pressure chamber and in contact with the regulator ball valve, wherein when a pressure within the low-pressure chamber lowers past a predetermined pressure, the regulator piston is biased by a primary regulator spring to push the regulator ball valve from the closed position to an open position wherein air flows from the high-pressure chamber to the low-pressure chamber until the pressure within the low-pressure chamber reaches the predetermined pressure, and a regulator piston support nut exposed on the surface of the outer housing and configured to adjust the predetermined pressure by adjusting a magnitude of the bias on the regulator piston created by the primary regulator spring, and a counter configured to track a number of bursts of air released through the air connector plate, wherein when the bolt carrier impacts the plunger, a burst of air is released from the air connector plate into the charge chamber to force the plunger rearward and reset the bolt carrier.

Particular embodiments may comprise one or more of the following features. The counter may comprise an indexing pin that extends from a side of a counting wheel as the counting wheel rotates until it engages with a release pin within the high-pressure air drum magazine and triggers release of any remaining air in the high-pressure air drum magazine from the high-pressure air drum magazine. The high-pressure air drum magazine may be sized, weighted and shaped to approximate the size, weight and shape of a drum magazine of an M249 rifle carrying 200 rounds of 5.56×45 mm ammunition cartridges. The regulator piston of the air regulator may further comprise a piston pin that rides within a sleeve of the regulator piston support nut, the sleeve being positioned within an inside diameter of the primary regulator spring and within a length of the primary regulator spring. The counter may comprise a pendulum configured to swing upon activation of the trigger, a pawl and ratchet rotatably coupled to the pendulum and configured to oscillate with the pendulum, a plurality of gears operably coupled to the pawl and ratchet, wherein each gear of the plurality of gears is configured as a Geneva mechanism for an adjacent gear and each gear corresponds to a number wheel displaying a number related to the number of bursts of air, and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine. The recoil kit may further comprise a counter reset button on a side of the high-pressure air drum magazine. The recoil kit may further comprise an electronic shot monitoring system coupled to the receiver and configured to extend from the receiver into a barrel of the weapon and transmit a signal when the recoil kit is activated. The recoil kit may further comprise a high-pressure air drum magazine refill station comprising a station base comprising a recess configured to receive the high-pressure air drum magazine seated within the recess, a pressure arm pivotally coupled to the station base and moveable between a raised position and a lowered position, wherein when in the lowered position the pressure arm is configured to secure the high-pressure air drum magazine within the recess, an air release nipple within the recess, the air release nipple communicatively coupled to a high-pressure air passage through the station base, and a high-pressure air receiver on a side of the station base communicatively coupled to the high-pressure air passage, wherein administration of high-pressure air to the high-pressure air receiver when a high-pressure air drum magazine is seated within the recess and the pressure arm is in its lowered position results in the high-pressure air drum magazine being refilled.

Aspects of this document relate to a tether-less, air-pressured recoil kit for a weapon having a trigger, the recoil kit comprising a receiver insert configured for attachment to a receiver of a belt-fed weapon, the receiver insert comprising a charge chamber comprising a biased plunger extending through a rear end of the charge chamber and an air-receiving nipple on a side of the charge chamber configured to receive air into the charge chamber, the biased plunger biased rearward toward the rear end and moveable between a forward position and a rearward position, and a bolt carrier configured to respond to weapon activation and force the plunger toward its forward position, an air connector plate configured to engage with the air-receiving nipple of the charge chamber when a feed cover of the weapon is in a closed position, and a high-pressure air drum magazine comprising an outer housing configured to connect to the weapon, the high-pressure air drum magazine in fluid communication with the air connector plate through a flexible air passage, a high-pressure chamber within the outer housing and sized to hold a predetermined quantity of pressurized air, a fill valve accessible from a surface of the outer housing, an air regulator communicatively coupled to the high-pressure chamber within the outer housing and configured to selectively pass air from the high-pressure chamber through the flexible air passage to the air connector plate, the air regulator comprising a regulator valve positioned between the high-pressure chamber and the low-pressure chamber, the regulator valve biased to a closed position, and a regulator piston exposed to the low-pressure chamber and in contact with the regulator valve, wherein the regulator piston is biased to push the regulator valve from the closed position to an open position until the pressure within the low-pressure chamber reaches the predetermined pressure, and a counter configured to track a number of bursts of air released through the air connector plate, wherein when the bolt carrier impacts the plunger, a burst of air is released from the air connector plate into the charge chamber.

Particular embodiments may comprise one or more of the following features. The air regulator may further comprise a regulator valve screw accessible at the surface of the outer housing and configured to adjust a magnitude of a bias on the regulator valve. The recoil kit may further comprise a regulator piston support nut exposed on the surface of the outer housing and configured to adjust the predetermined pressure by adjusting a magnitude of a bias on the regulator piston. The high-pressure air drum magazine may be sized, weighted and shaped to approximate the size, weight and shape of a drum magazine of an M249 rifle carrying 200 rounds of 5.56×45 mm ammunition cartridges. The recoil kit may further comprise a high-pressure air drum magazine refill station comprising a station base comprising a recess configured to receive the high-pressure air drum magazine seated within the recess, a pressure arm pivotally coupled to the station base and moveable between a raised position and a lowered position, wherein when in the lowered position the pressure arm is configured to secure the high-pressure air drum magazine within the recess, an air release nipple within the recess, the air release nipple communicatively coupled to a high-pressure air passage through the station base, and a high-pressure air receiver on a side of the station base communicatively coupled to the high-pressure air passage, wherein administration of high-pressure air to the high-pressure air receiver when a high-pressure air drum magazine is seated within the recess and the pressure arm is in its lowered position results in the high-pressure air drum magazine being refilled. The counter may comprise a pendulum configured to swing upon activation of the trigger, a pawl and ratchet rotatably coupled to the pendulum and configured to oscillate with the pendulum, a plurality of gears operably coupled to the pawl and ratchet, wherein each gear of the plurality of gears is configured as a Geneva mechanism for an adjacent gear and each gear corresponds to a number wheel displaying a number related to the number of bursts of air, and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine.

Aspects of this document relate to a tether-less, air-pressured recoil kit for a weapon having a trigger, the recoil kit comprising a receiver insert configured for attachment to a receiver of a weapon, the receiver insert comprising a charge chamber comprising a plunger extending through a rear end of the charge chamber and moveable between a forward position and a rearward position, and a bolt carrier configured to respond to weapon activation and force the plunger toward its forward position, an air connector plate configured to engage with the charge chamber, and a high-pressure air drum magazine comprising an outer housing and in fluid communication with the air connector plate through an air passage, a high-pressure chamber within the outer housing, and an air regulator communicatively coupled to the high-pressure chamber and configured to selectively pass air from the high-pressure chamber to the air connector plate, wherein when the bolt carrier impacts the plunger, a burst of air is released from the air connector plate into the charge chamber.

Particular embodiments may comprise one or more of the following features. The air regulator may comprise a regulator valve positioned between the high-pressure chamber and the low-pressure chamber, the regulator valve biased to a closed position, a regulator valve screw exposed on a surface of the outer housing and configured to adjust a magnitude of a bias on the regulator valve, a regulator piston exposed to the low-pressure chamber and in contact with the regulator valve, wherein when a pressure within the low-pressure chamber lowers past a predetermined pressure, the regulator piston is biased to push the regulator valve from the closed position to an open position wherein air flows from the high-pressure chamber to the low-pressure chamber until the pressure within the low-pressure chamber reaches the predetermined pressure, and a regulator piston support nut exposed on the surface of the outer housing and configured to adjust the predetermined pressure by adjusting a magnitude of the bias on the regulator piston. The recoil kit may further comprise a counter within the outer housing and configured to track a number of bursts of air released through the air connector plate. The counter may comprise a pendulum configured to swing upon activation of the trigger, a pawl and ratchet rotatably coupled to the pendulum and configured to oscillate with the pendulum, a plurality of gears operably coupled to the pawl and ratchet, wherein each gear of the plurality of gears is configured as a Geneva mechanism for an adjacent gear and each gear corresponds to a number wheel displaying a number related to the number of bursts of air, and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine. The high-pressure air drum magazine may be sized, weighted and shaped to approximate the size, weight and shape of a drum magazine of an M249 rifle carrying 200 rounds of 5.56×45 mm ammunition cartridges. The recoil kit may further comprise high-pressure air drum magazine refill station comprising a station base comprising a recess configured to receive the high-pressure air drum magazine seated within the recess, a pressure arm pivotally coupled to the station base and moveable between a raised position and a lowered position, wherein when in the lowered position the pressure arm is configured to secure the high-pressure air drum magazine within the recess, an air release nipple within the recess, the air release nipple communicatively coupled to a high-pressure air passage through the station base, and a high-pressure air receiver on a side of the station base communicatively coupled to the high-pressure air passage, wherein administration of high-pressure air to the high-pressure air receiver when a high-pressure air drum magazine is seated within the recess and the pressure arm is in its lowered position results in the high-pressure air drum magazine being refilled.

The foregoing and other aspects, features, applications, and advantages will be apparent to those of ordinary skill in the art from the specification, drawings, and the claims. Unless specifically noted, it is intended that the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred embodiments, but in addition, include any and all structures, materials or acts that perform the claimed function as described in alternative embodiments or forms of the disclosure, or that are well known present or later-developed, equivalent structures, material or acts for performing the claimed function.

The foregoing and other aspects, features, and advantages will be apparent to those of ordinary skill in the art from the specification, drawings, and the claims.

BRIEF DESCRIPTION OF THE DRAWINGS

Implementations will hereinafter be described in conjunction with the appended drawings, where like designations denote like elements, and.

Figure 1:
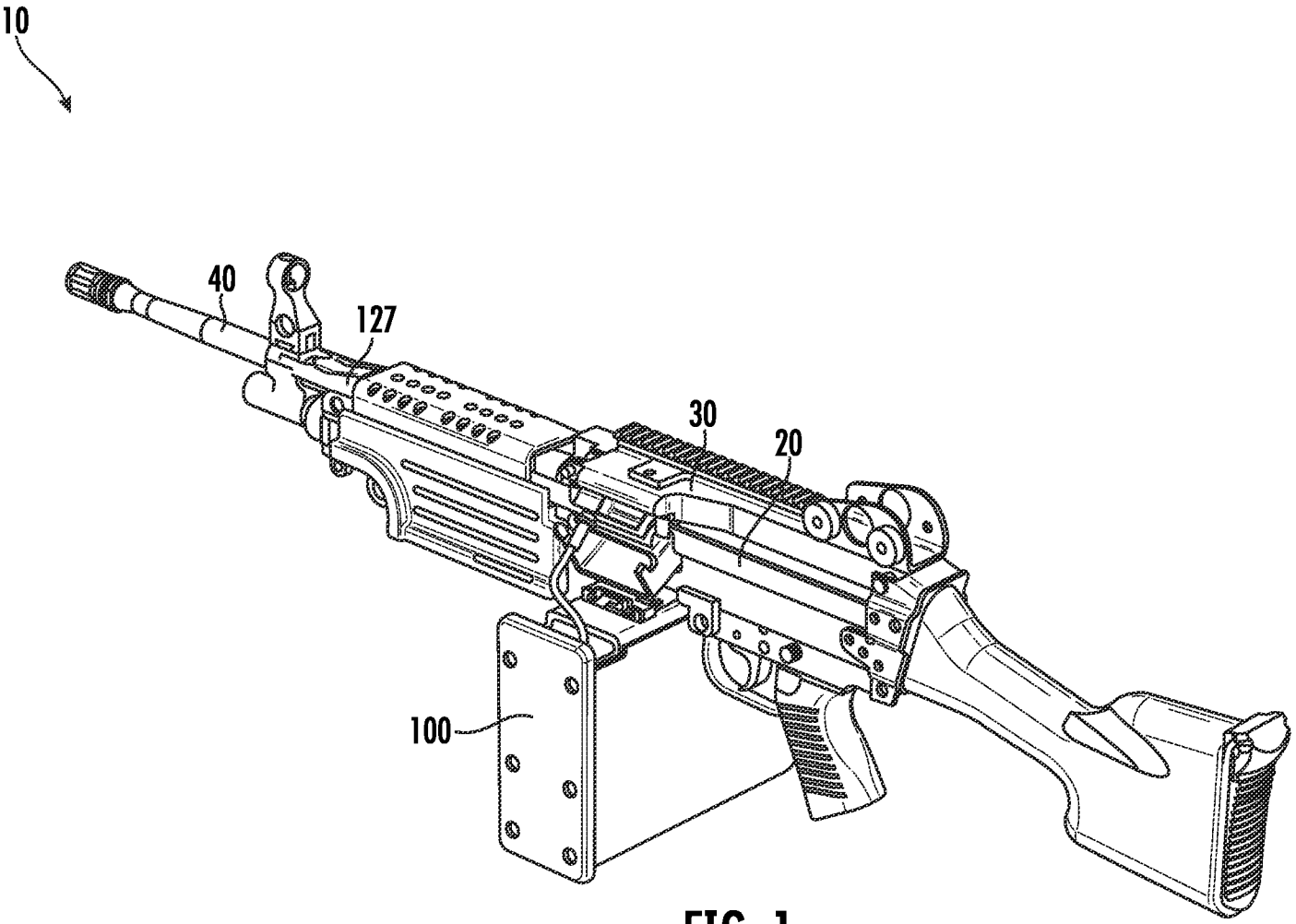
FIG. 1 is a perspective view of a tether-less, air-pressured recoil kit for a weapon having a trigger, attached to the weapon.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of implementations.

DETAILED DESCRIPTION

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations that are described in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

In the following description, reference is made to the accompanying drawings which form a part hereof, and which show by way of illustration possible implementations. It is to be understood that other implementations may be utilized, and structural, as well as procedural, changes may be made without departing from the scope of this document. As a matter of convenience, various components will be described using exemplary materials, sizes, shapes, dimensions, and the like. However, this document is not limited to the stated examples and other configurations are possible and within the teachings of the present disclosure. As will become apparent, changes may be made in the function and/or arrangement of any of the elements described in the disclosed exemplary implementations without departing from the spirit and scope of this disclosure.

The present disclosure is related to a tether-less, air-pressure recoil kit 100 for a weapon 10 having a trigger. The recoil kit 100 is tether-less, which means that there are no connections or couplings extending from the recoil kit 100 to an external source of pressurized air. Instead, the recoil kit 100 is configured to have its own supply of pressurized air within the drum magazine of the weapon 10. This allows the weapon 10 to be designed with the same feel as a typical firearm so that training that is undergone using the weapon 10 is more effective in helping the trainee experience situations that are more like real life than would otherwise be possible. The present disclosure is closely related to the subject matter of U.S. patent application Ser. No. 17/330,166, titled HIGH-PRESSURE AIR MAGAZINE, filed May 25, 2021, to Kinnard, et. al., the disclosure of which is hereby incorporated herein by this reference.

Throughout this disclosure, the term "drum magazine" is used to refer to the part of the weapon 10 from which ammunition is fed into the weapon 10. For the purposes of this disclosure, references to a "drum magazine" or a drum magazine as part of a recoil kit is intended to encompass and equally apply to any of a box, a box magazine, a drum, a drum magazine, an ammunition pouch, an ammunition box, or any other device configured to store ammunition and feed it to the weapon 10.

Figure 2:
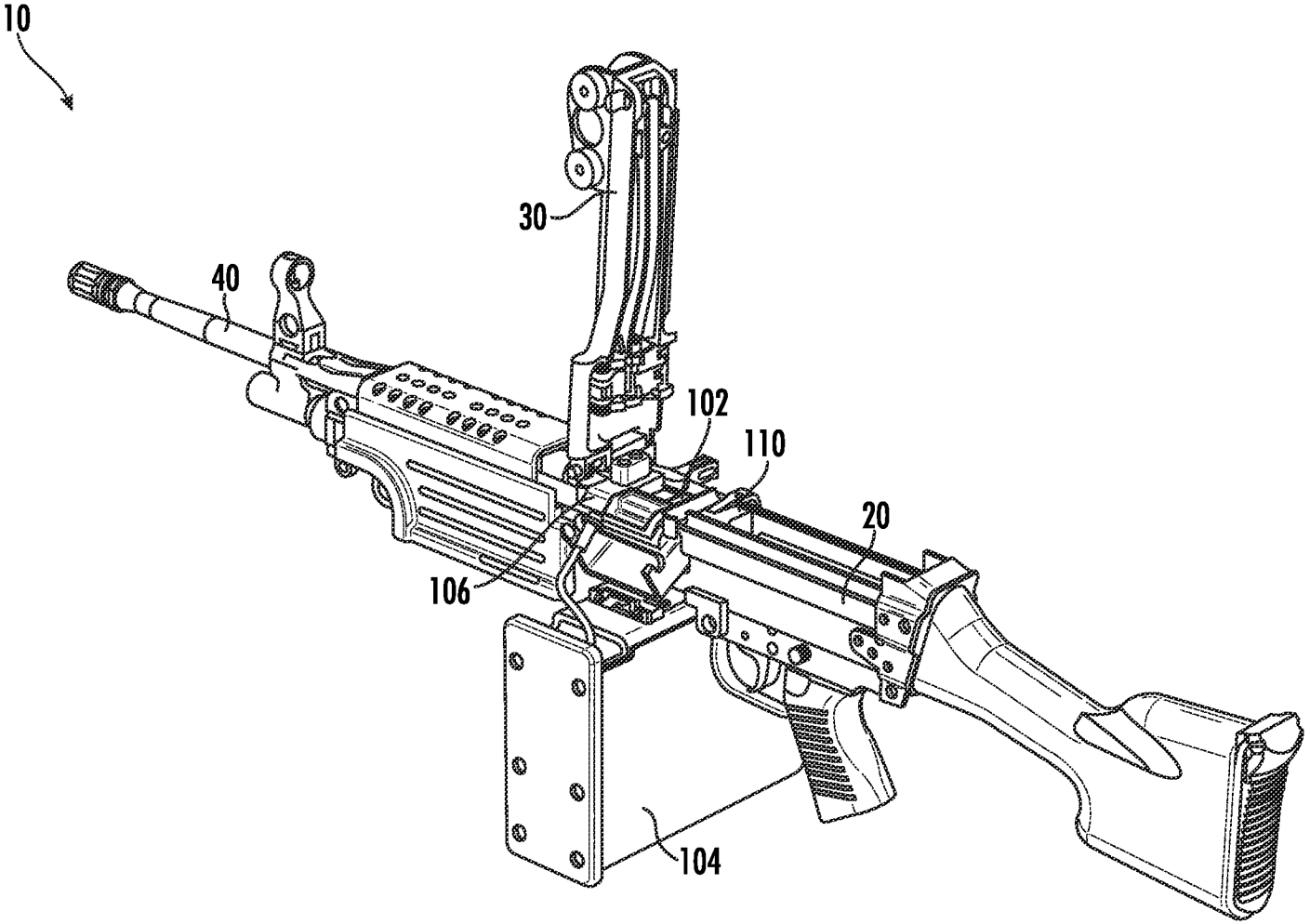
FIG. 2 is a perspective view of the recoil kit attached to the weapon shown in FIG. 1 with the feed cover in the open position.
Figure 3:
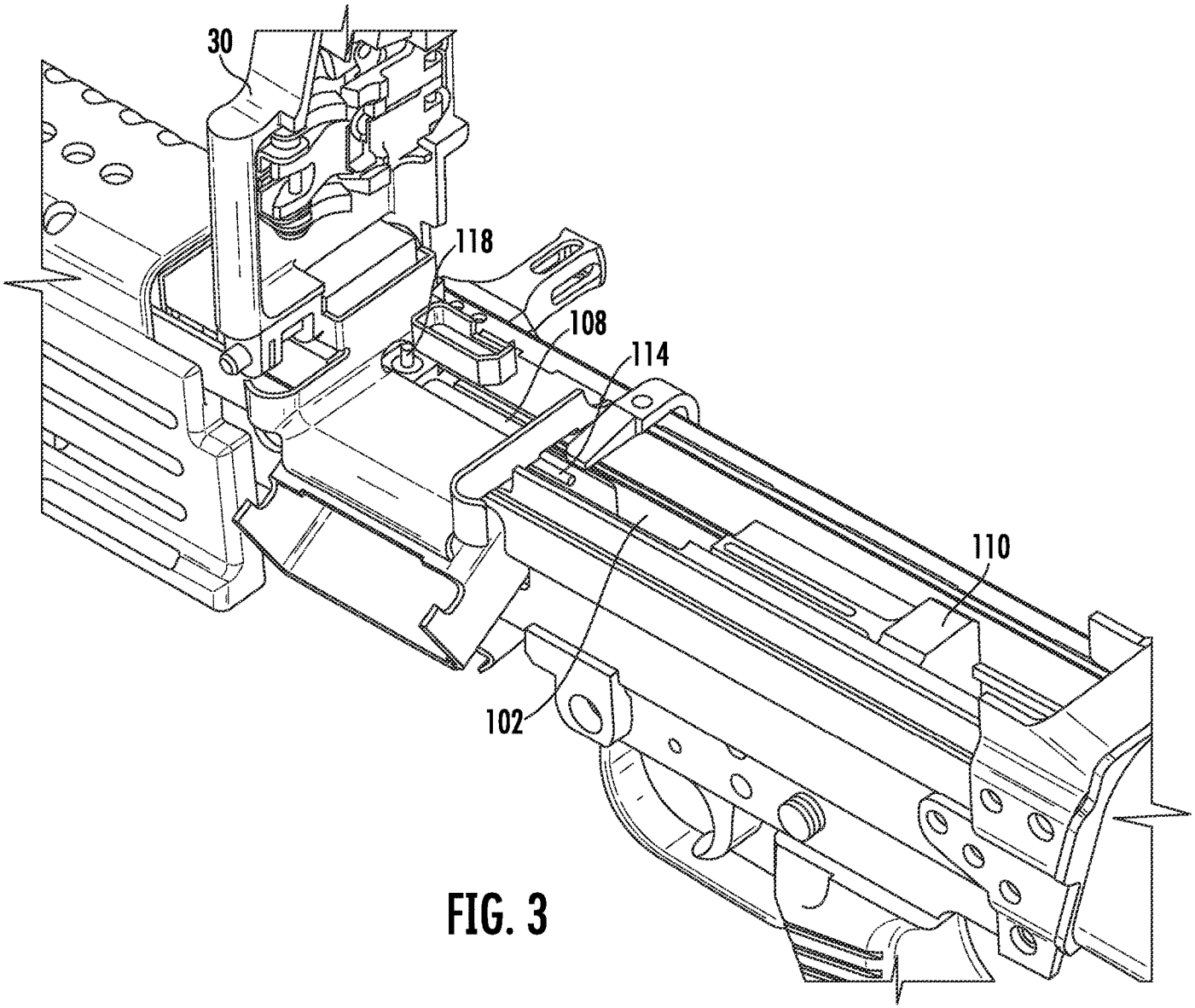
FIG. 3 is a close-up view of a portion of the recoil kit shown in FIG. 1 with the feed cover in the open position.
Figure 4:
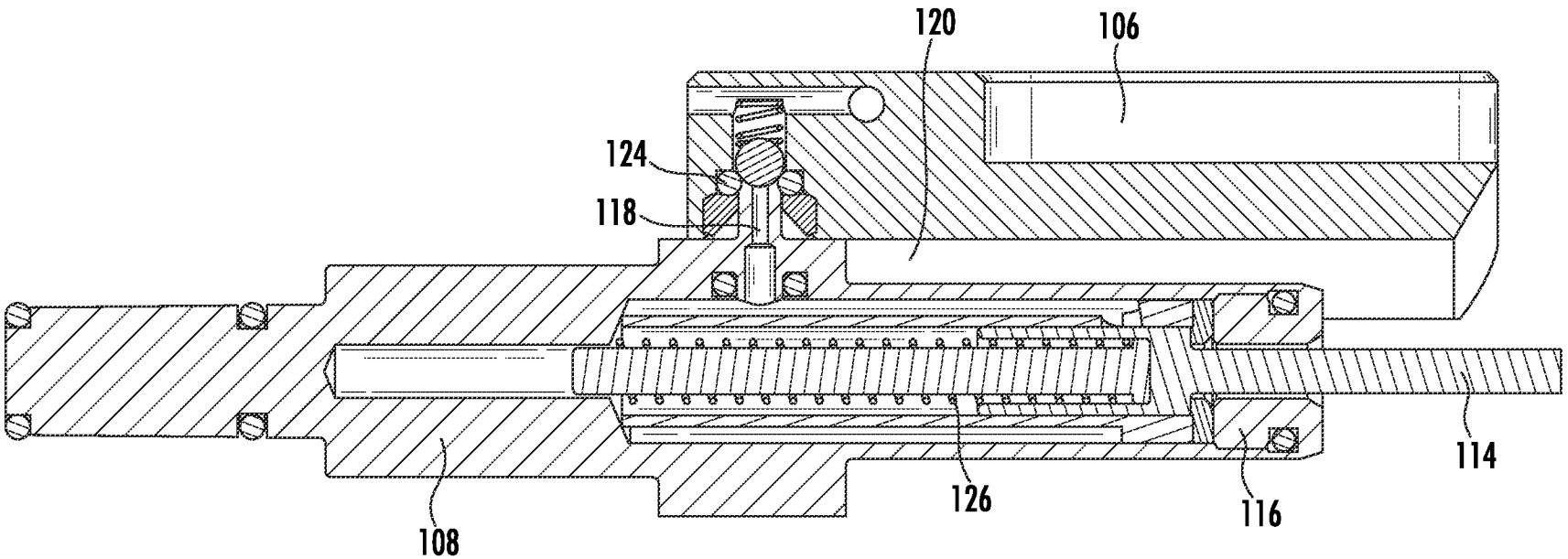
FIG. 4 is a cross section view of the charge chamber of the recoil kit shown in FIG. 1.
Figure 5:
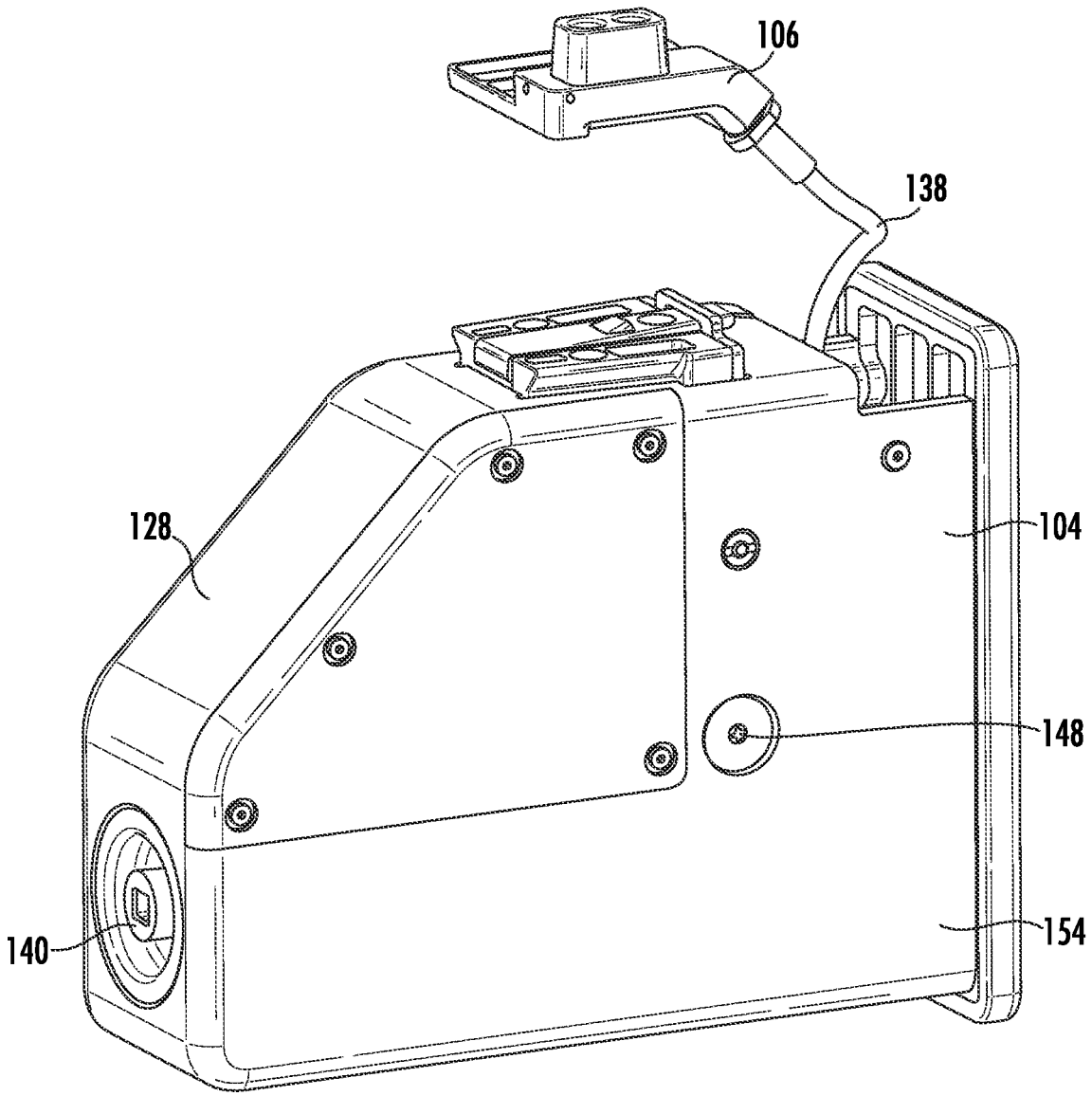
FIG. 5 is a perspective view of the air connector plate and high-pressure air ("HPA") drum magazine of the recoil kit shown in FIG. 1.

As shown in FIGS. 1-2, the recoil kit 100 may comprise a receiver insert 102, a high-pressure air drum magazine 104, and an air connector plate 106 fluidly coupling the high-pressure air drum magazine 104 to the receiver insert 102. The receiver insert 102 is configured for attachment to a receiver 20 of a belt-fed weapon 10. The receiver insert 102 may comprise a charge chamber 108 and a bolt carrier 110, as shown in FIGS. 3-4. When the receiver insert 102 is inserted or attached to the receiver 20, the original spring of the weapon 10 may be replaced with a different spring with the same spring constant or a different spring constant. Alternatively, the original spring of the weapon 10 may be retained for use with the recoil kit 100. This simplifies the change between a training mode using the recoil kit 100 and a live mode using live ammunition because the same spring can be used in both modes.

In particular embodiments, the charge chamber 108 comprises a biased plunger 114 that extends through a rear end 116 of the charge chamber 108 and an air-receiving nipple 118 on a side 120 of the charge chamber 108. The air-receiving nipple 118 is configured to receive air into the charge chamber 108. The biased plunger 114 may be moveable between a forward position (see FIG. 2) and a rearward position (see FIG. 3) and may be biased rearward toward the rear end 116, toward the rearward position.

The bolt carrier 110 is configured to respond to the trigger being activated on the weapon 10. The response of the bolt carrier 110 may be to move the plunger 114 from its rearward position toward its forward position. A feed cover 30 of the weapon may be hingedly coupled to a base of the receiver 20. This allows the feed cover 30 to be moveable between an open position (see FIG. 2) and a closed position (see FIG. 3). The feed cover 30 is configured to selectively lock against the receiver 20 and selectively maintain the feed cover 30 in the closed position. This motion allows the air connector plate 106 to be coupled with the air-receiving nipple 118 while the feed cover 30 is in the open position, and the feed cover 30 to then be moved to the closed position, thus locking the air connector plate 106 in fluid communication with the air-receiving nipple 118. The air connector plate 106 may comprise a seal 124 and may be configured to sealingly engage with the air-receiving nipple 118 of the charge chamber 108. Additionally, the air connector plate 106 may be configured to become locked in place between the charge chamber 108 and the feed cover 30 when the feed cover 30 is locked in its closed position.

The receiver insert 102 functions as follows. When the trigger of the weapon 10 is activated, the bolt carrier 110 is propelled forward to move the plunger 114 from its rearward position toward its forward position. As shown in FIG. 4, this compresses the air within the charge chamber 108 and opens the air-receiving nipple 118. Once the charge chamber 108 is exposed to the air pressure from the high-pressure air drum magazine 104 through the air connector plate 106, the plunger 114 is rapidly pushed back to it rearward position by the increased air pressure from the high-pressure air drum magazine 104 and the biasing element 126, which may be a spring. Thus, when the bolt carrier 110 impacts the plunger 114, a burst of air is released from the air connector plate 106 into the charge chamber 108 to force the plunger 114 rearward. The plunger 114 thus pushes the bolt carrier 110 rearward. When the bolt carrier 110 makes contact with the weapon 10, the kinetic energy within the bolt carrier 110 is transferred to the weapon 10, resetting the bolt carrier 110 in a position to be propelled again upon activation of the trigger of the weapon 10 and causing the weapon 10 to simulate a recoil. Thus, the high-pressure air drum magazine 104 is configured to supply pressurized air to the receiver insert 102, which is configured to simulate a recoil of the weapon 10 upon activation of the trigger of the weapon 10. The recoil kit 100 may also comprise an electronic shot monitoring system 127 coupled to the receiver 20. The electronic shot monitoring system 127 is configured to extend from the receiver 20 into a barrel 40 of the weapon 10 and transmit a signal when the recoil kit 100 is activated.

Turning to FIGS. 5-12, the high-pressure air drum magazine 104 may comprise an outer housing 128, a high-pressure chamber 130 and a low-pressure chamber 132 both within the outer housing 128, a fill valve 134, an air regulator 136 configured to pass air from the high-pressure chamber 130 to the low-pressure chamber 132, and an air passage 138. The high-pressure air drum magazine 104 may be sized, weighted, and shaped to approximate the size, weight, and shape of a drum magazine of an M249 rifle carrying 200 rounds of 5.56×45 mm ammunition cartridges. Alternatively, the high-pressure air drum magazine 104 may be sized, weighted, and shaped to approximate the size, weight and shape of a drum magazine of any other weapon type carrying any number of rounds of any size cartridge. The outer housing 128 is sized and shaped to couple with the weapon 10. In some embodiments, the outer housing 128 is configured to connect to a side of the weapon 10, such as a bottom side of the weapon 10. The outer housing 128 may be formed of a material selected to achieve a balance between the weight of the high-pressure air drum magazine 104 and its strength. The high-pressure air drum magazine 104 must have sufficient structural strength to withstand high pressures within the outer housing 128, which may be around 3000 psi and may exceed 7000 psi. Additionally, the high-pressure air drum magazine 104 should approximate the weight of a loaded drum magazine. One example of a material that achieves a good weight/strength balance is aluminum, particularly a 6061-T6 aluminum. Other materials may also be used, such as carbon fiber or other metals and alloys. The outer housing 128 may be formed into the shape of a conventional drum magazine. The outer housing 128 may be formed of multiple parts which are then welded together. Alternatively, the outer housing 128 may be formed of a single piece of material. For example, the outer housing 128 may be molded or may be shaped with a computer numerical control (CNC) machine.

The high-pressure chamber 130 may be a removeable cartridge or may be formed directly into the outer housing 128. The high-pressure chamber 130 is sized to hold a predetermined quantity of pressurized air. The predetermined quantity of pressurized air is based on the number of rounds that a drum magazine of the weapon 10 typically holds and the amount of air that is expelled from the high-pressure chamber 130 per round. Thus, the size of the high-pressure chamber 130 is determined based on the number of rounds needed, the amount of air expelled per round, and the desired pressure for the high-pressure chamber 130. In some embodiments, the desired pressure for the high-pressure chamber 130 may be between 3,000 and 7,000 psi. The high-pressure chamber 130 may be formed into any shape. In some embodiments, the high-pressure chamber 130 is formed with rounded surfaces for improved force distribution and chamber strength. The high-pressure chamber 130 may be one large cavity or may include multiple cavities. For example, while the embodiments shown in the FIGs. only show one large cavity, the high-pressure chamber 130 may include more than one cavity, such as three individual cavities. The individual cavities may be fluidly joined together so that the pressure within each cavity is equalized. Alternatively, the individual cavities may be fluidly isolated. A chamber plug 140 seals the high-pressure chamber 130 from the outside pressure. In some embodiments, the chamber plug 140 has an O-ring 152 or other seal to prevent air from escaping. In other embodiments, the chamber plug 140 is laser welded or otherwise permanently attached to the high-pressure air drum magazine 104.

While the cavities described are designed so they can be efficiently drilled in one operation per cavity using a drill bit with a half-dome tip, it is contemplated that a single or double pocket could be created with sufficient volume to both hold adequate air for the operation of a predetermined number of shots (such as 200 recoil shots), even at temperatures below freezing as well as helping to keep the weight of the drum magazine to within +/−10% of the weight of a real drum magazine with a full load of bullets. To ensure the finalized drum magazine reaches this ideal weight range, or even closer tolerances, additional pockets devoid of material could be used in non-critical areas of the high-pressure air drum magazine 104 so that the overall form and outside dimensions of the high-pressure air drum magazine 104 are not affected to enhance the real-world experience during the training while reducing the overall weight. By staying true to the look, shape, feel and weight of a real drum magazine, while avoiding making the high-pressure chamber 130 larger than necessary, training effectiveness is enhanced. If the high-pressure chamber 130 is larger than necessary, the larger chamber volume could cause an external reserve-refill tank to empty faster than if the high-pressure chamber 130 were a smaller, ideal size for operation.

Figure 8:
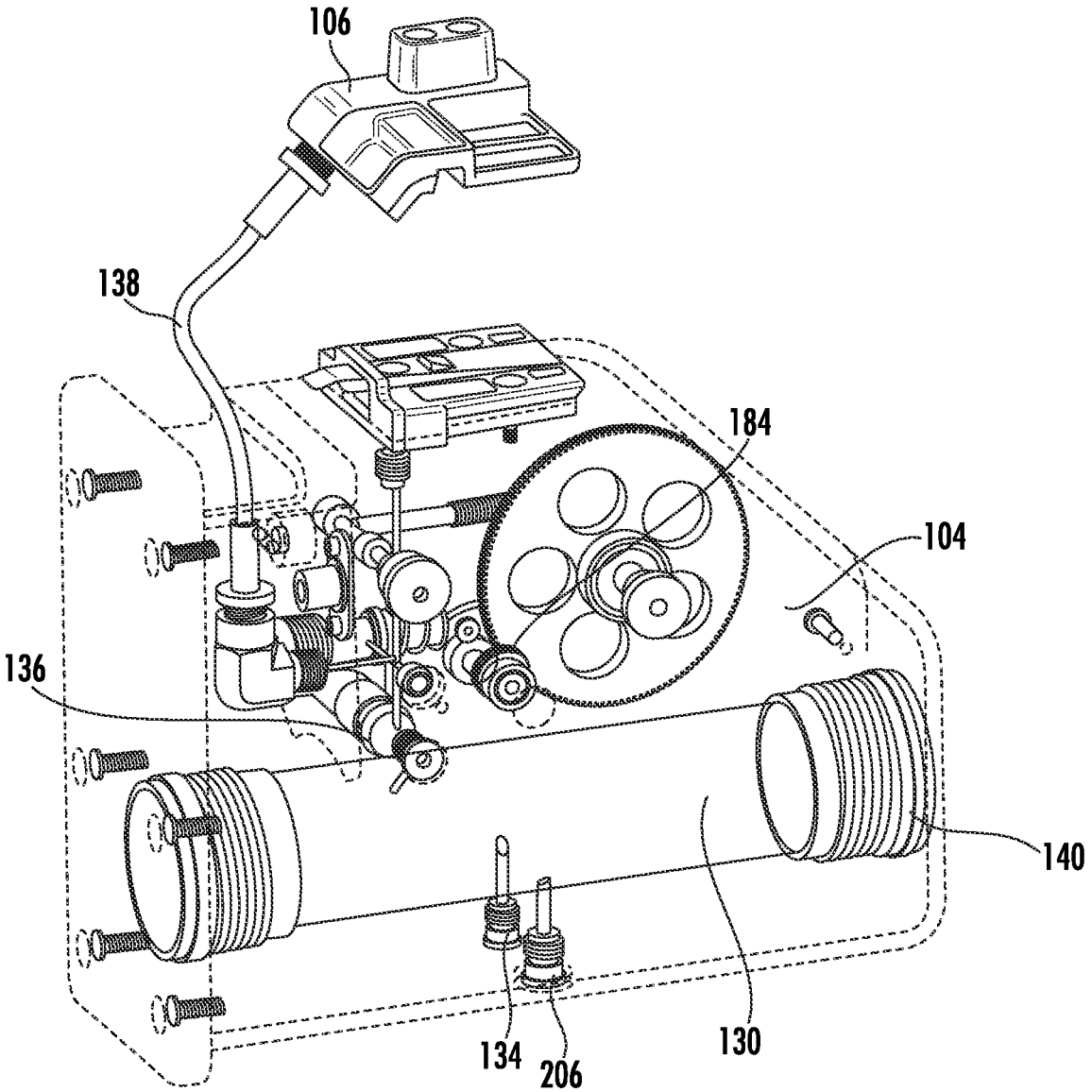
FIG. 8 is a perspective view of the HPA drum magazine shown in FIG. 5 with the outer housing translucent to show the internal structure of the HPA drum magazine.
Figure 9:
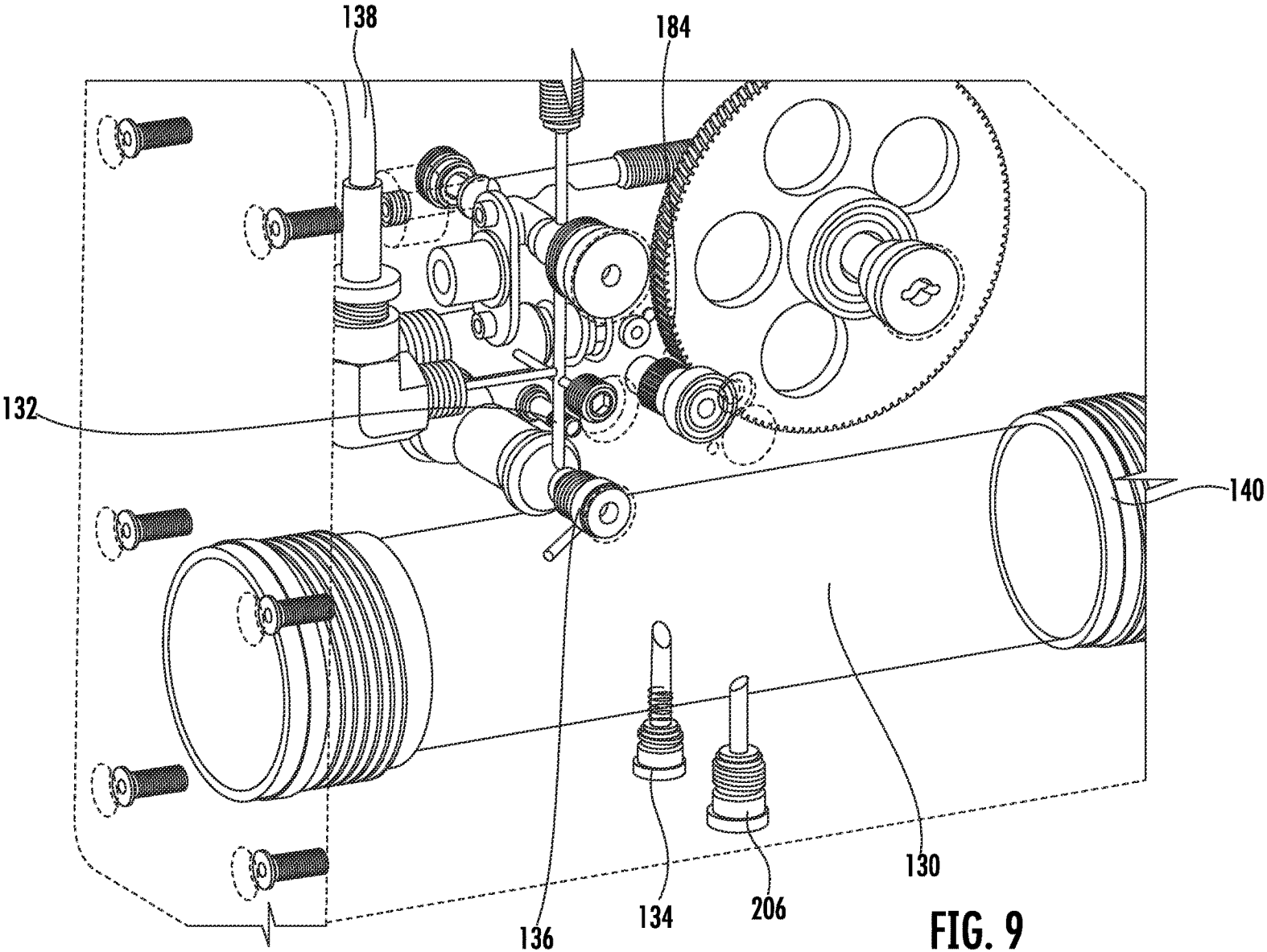
FIG. 9 is a close-up view of the internal structure of the HPA drum magazine shown in FIG. 8.
Figure 10:
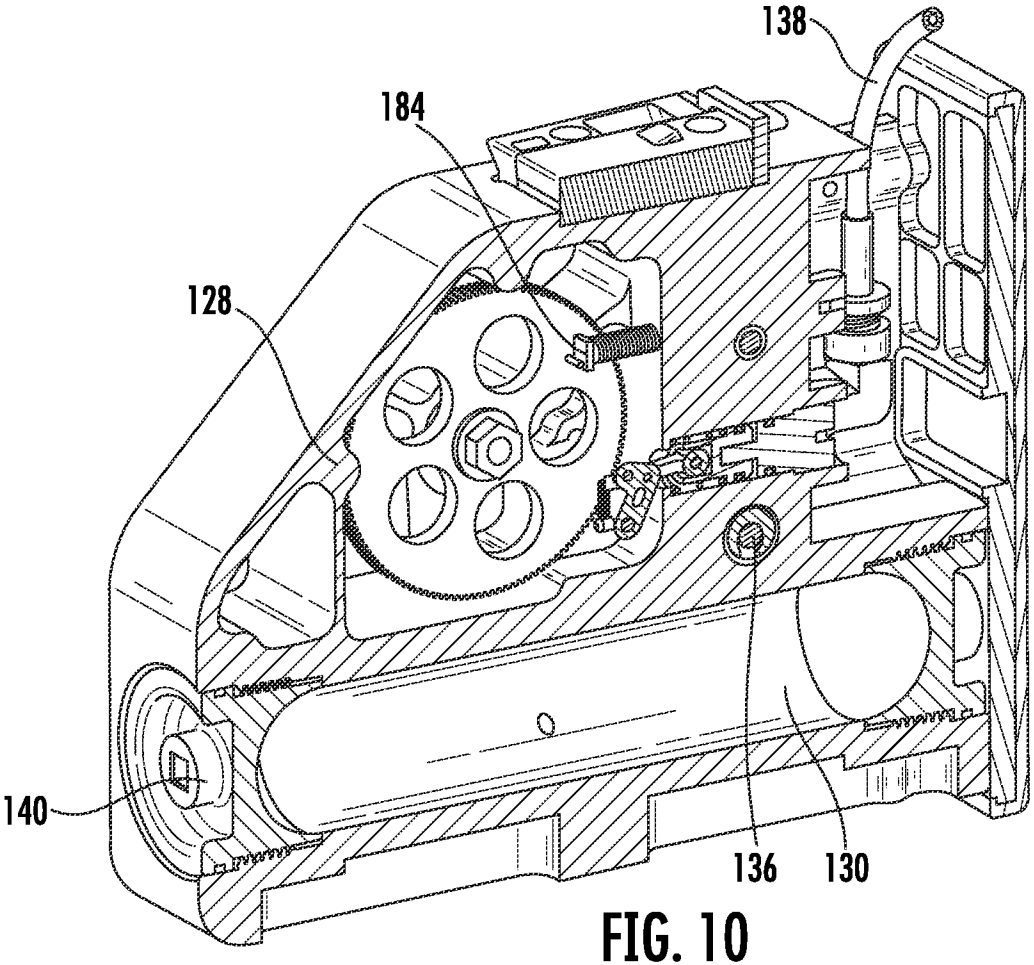
FIG. 10 is a cross section view of the HPA drum magazine shown in FIG. 5 showing a first embodiment of the counter.

The low-pressure chamber 132 may also be a removeable cartridge or may be formed directly into the outer housing 128. As illustrated in FIGS. 8-9, the low-pressure chamber 132 is fluidly coupled to the high-pressure chamber 130 through the air regulator 136 and is fluidly coupled to the air passage 138. The air passage 138 fluidly couples the low-pressure chamber 132 to the air connector plate 106. The air passage 138 may be flexible or rigid. The low-pressure chamber 132 is configured to hold a quantity of air that is sufficient to simulate one recoil of the weapon 10. Thus, each time the weapon 10 is activated, the low-pressure chamber 132 releases pressurized air through the air passage 138 to the air connector plate 106 and the receiver insert 102. As disclosed in more detail below, the low-pressure chamber 132 is then refilled with pressurized air from the high-pressure chamber 130 through the air regulator 136.

The air regulator 136 is positioned between and fluidly coupled to the high-pressure chamber 130 and the low-pressure chamber 132 and is configured to selectively pass air from the high-pressure chamber 130 to the low-pressure chamber 132. The air regulator 136 may comprise a regulator ball valve 142, a regulator valve screw 144, a regulator piston 146, and a regulator piston support nut 148. The regulator ball valve 142 may be positioned between the high-pressure chamber 130 and the low-pressure chamber 132 and may be biased by a compression spring 150 to a closed position wherein airflow from the high-pressure chamber 130 to the low-pressure chamber 132 is minimized. An O-ring 152 may be positioned between the regulator ball valve 142 and the low-pressure chamber 132 to further minimize airflow from the high-pressure chamber 130 to the low-pressure chamber 132. The O-ring 152 may have a seat configured to decrease the likelihood that the O-ring 152 enters the opening joining the high-pressure chamber 130 and the low-pressure chamber 132. The regulator valve screw 144 may be positioned adjacent to the compression spring 150 and may be exposed on a surface 154 of the outer housing 128. The regulator valve screw 144 is configured to adjust a magnitude of the bias on the regulator ball valve 142. For example, the regulator valve screw 144 may be threaded into the outer housing 128 and can be screwed towards or away from the compression spring 150, compressing or releasing the compression spring 150. Thus, the bias may be increased by screwing the regulator valve screw 144 toward the compression spring 150 and may be decreased by screwing the regulator valve screw 144 away from the compression spring 150. In particular embodiments, the regulator valve screw 144 may not be included, and the magnitude of the bias on the regulator ball valve 142 may not be adjustable.

The regulator piston 146 is exposed to the low-pressure chamber 132 and is configured to contact the regulator ball valve 142. When the pressure within the low-pressure chamber 132 lowers past a predetermined pressure, the regulator piston 146 is biased by a primary regulator spring 156 to push the regulator ball valve 142 from the closed position to an open position. When the regulator ball valve 142 is in the open position, air flows from the high-pressure chamber 130 to the low-pressure chamber 132 until the pressure within the low-pressure chamber 132 reaches the predetermined pressure, at which point the regulator ball valve 142 returns to the closed position. In the event that the pressure within the high-pressure chamber 130 lowers past the predetermined pressure, the regulator ball valve 142 remains in the open position. In some embodiments, the predetermined pressure may be between 1,000 and 1,500 psi. The predetermined pressure may be selected based on the desired pressure and quantity of air released with each activation of the weapon 10.

During the cycling of the air regulator 136, the regulator piston 146 encounters violent forces from the primary regulator spring 156. These forces and vibration tend to make the regulator piston 146 move off axis. It has been discovered that this off-axis movement can lead to piston seizure in the regulator bore. To alleviate this condition, some embodiments of the regulator piston support nut 148 have a sleeve 158 in which a piston pin 159 of the regulator piston 146 rides or moves back and forth. This helps to keep the regulator piston 146 aligned. Due to space constraints, the sleeve 158 may be positioned within the inside diameter of the primary regulator spring 156 and within the length of the primary regulator spring 156 to fit within the drum magazine width restrictions. In order to restrict the off-axis movement, the sleeve 158 may include a large engagement-length-to-diameter ratio. Additionally, the sleeve 158 may be made from a material with suitable strength to retain the regulator piston 146 and prevent galling with the regulator piston 146.

In embodiments that have a regulator piston support nut 148, the regulator piston support nut 148 is exposed on the surface 154 of the outer housing 128, with the primary regulator spring 156 positioned between the regulator piston support nut 148 and the regulator piston 146, and is configured to adjust the predetermined pressure by adjusting a magnitude of the bias on the regulator piston 146 created by the primary regulator spring 156. In this regard, the regulator piston support nut 148 functions similar to the regulator valve screw 144. When the regulator piston support nut 148 is screwed towards the primary regulator spring 156, the predetermined pressure is increased because the primary regulator spring 156 exerts a greater bias on the regulator piston 146, and thus greater pressure within the low-pressure chamber 132 is required to prevent the regulator piston 146 from moving the regulator ball valve 142 to the open position. On the other hand, when the regulator piston support nut 148 is screwed away from the primary regulator spring 156, the predetermined pressure is decreased because the primary regulator spring 156 exerts a lesser bias on the regulator piston 146, and thus less pressure within the low-pressure chamber 132 is required to prevent the regulator piston 146 from moving the regulator ball valve 142 to the open position. In particular embodiments, the regulator piston support nut 148 may not be included, and the magnitude of the bias on the regulator piston 146 may not be adjustable.

In particular embodiments, a simple adjustment of the regulator piston support nut 148 also adjusts the pressure of air exerted on the weapon with each shot so that the recoil force can be specifically customized to the weapon 10 into which the high-pressure air drum magazine 104 will be used. The regulator piston support nut 148 allows the recoil force of each high-pressure air drum magazine 104 to be individually adjusted as needed. In other embodiments, the regulator piston support nut 148 may not be included, and the recoil force may not be adjustable. Because the air regulator 136 regulates between the high-pressure chamber 130 and low-pressure chamber 132 using the regulator ball valve 142, the regulator valve screw 144, the regulator piston 146, and the primary regulator spring 156, the pressure equilibrium reached maintains a fairly constant pressure in the low-pressure chamber 132 with each recharge, even when the pressure in the high-pressure chamber 130 is reduced. This helps to maintain a more consistent recoil force and feel for the user.

Figure 6:
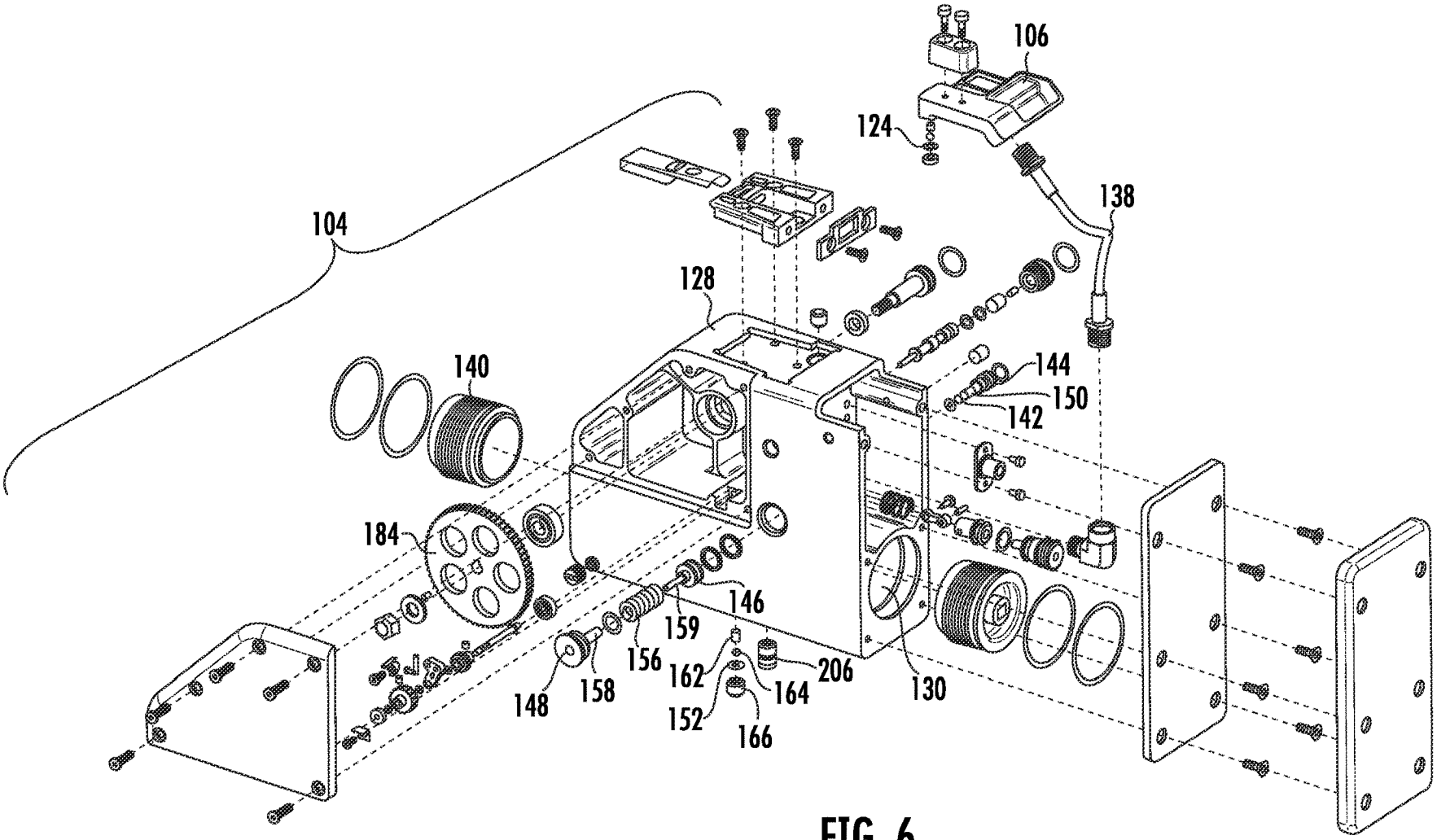
FIG. 6 is an exploded view of the air connector plate and HPA drum magazine shown in FIG. 5.
Figure 11:
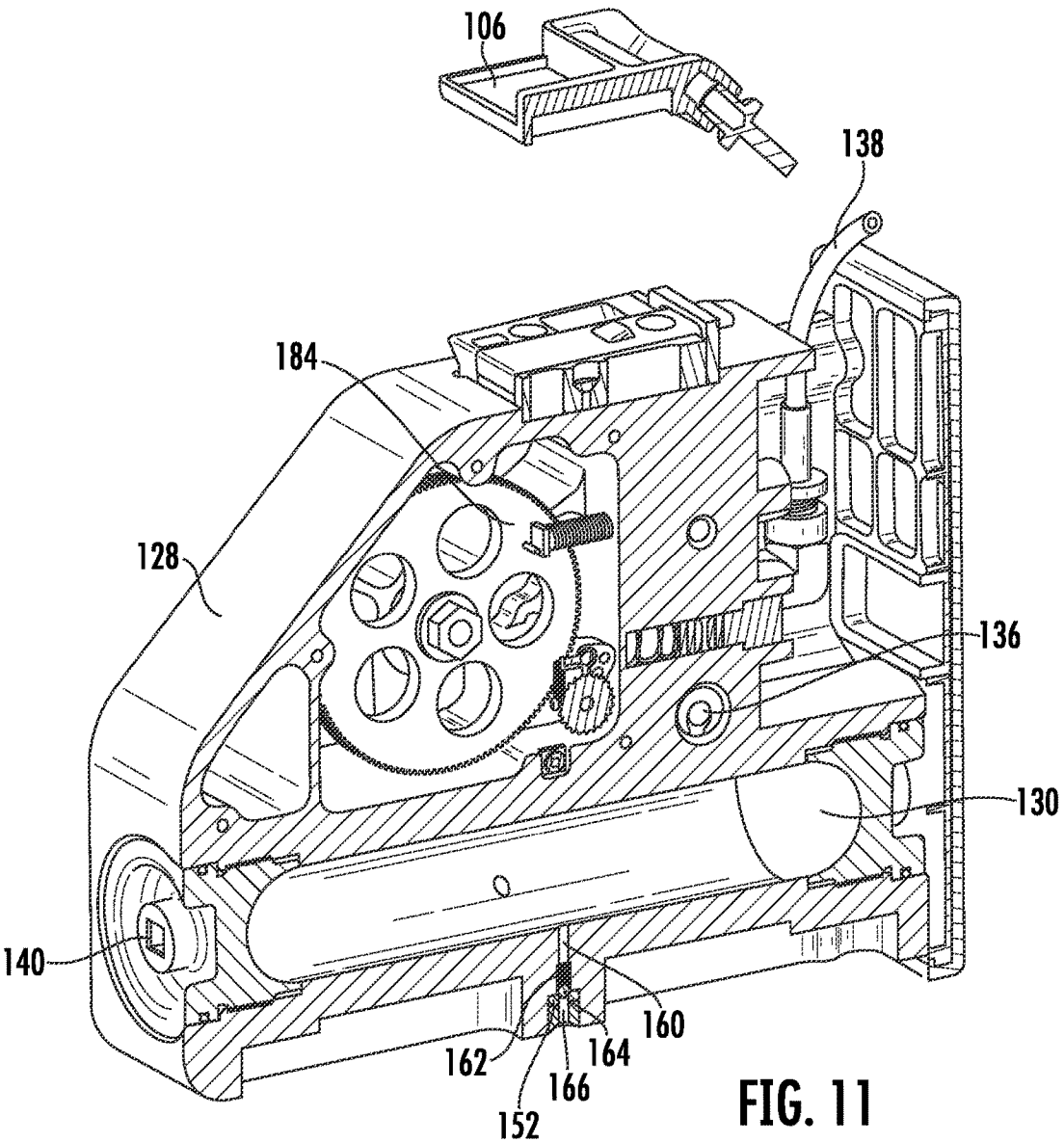
FIG. 11 is a cross section view of the HPA drum magazine shown in FIG. 5 showing the fill port and fill valve.
Figure 12:
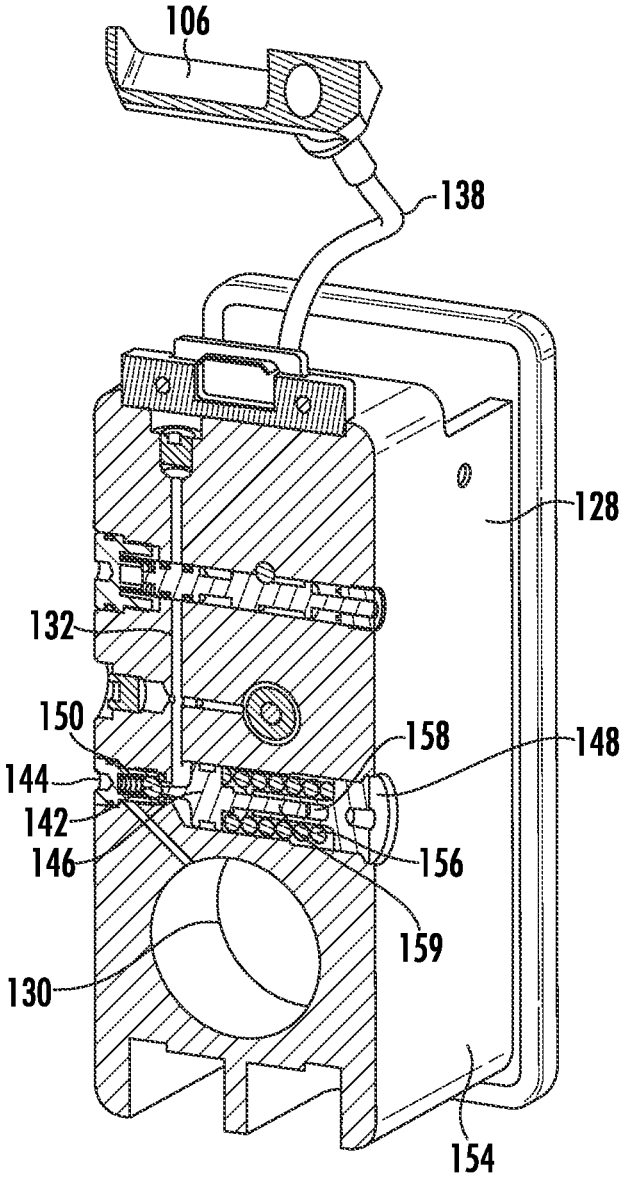
FIG. 12 is another cross-section view of the HPA drum magazine shown in FIG. 5 showing the air regulator and low-pressure chamber.

The fill valve 134 is disposed between the high-pressure chamber 130 and a fill port 160 exposed on a surface 154 of the outer housing 128 and may be any fill valve known in the industry for handling high pressure air. The fill valve 134 is configured to couple with a high-pressure nozzle through the fill port 160 to fill the high-pressure chamber 130 with pressurized air. Thus, the high-pressure air drum magazine 104 can be coupled with a tank of pressurized air to recharge the high-pressure air drum magazine 104. As illustrated in FIGS. 6 and 11, the fill valve 134 may include a compression spring 162 and a ball or bearing 164. The compression spring 162 may press the ball or bearing 164 against an O-ring 152 that surrounds the fill port 160 to restrict air from escaping the high-pressure chamber 130. An externally threaded retaining nut 166 may be screwed into the fill port 160 to provide a seat for the O-ring 152 when the ball or bearing 164 is pressed against the fill port 160 by the compression spring 162 and the pressure within the high-pressure chamber 130. Thus, air is restricted from escaping through the fill valve 134, but air can be inserted into the high-pressure chamber 130 by pressing the high-pressure nozzle into the fill valve 134, thus moving the ball or bearing 164 from its closed position and allowing air to enter the high-pressure chamber 130. The seat provided by the externally threaded retaining nut 166 for the O-ring 152 surrounding the fill port 160 may be flat, as shown in FIG. 11. The flat seat decreases the likelihood of the fill valve 134 locking up.

Figure 13:
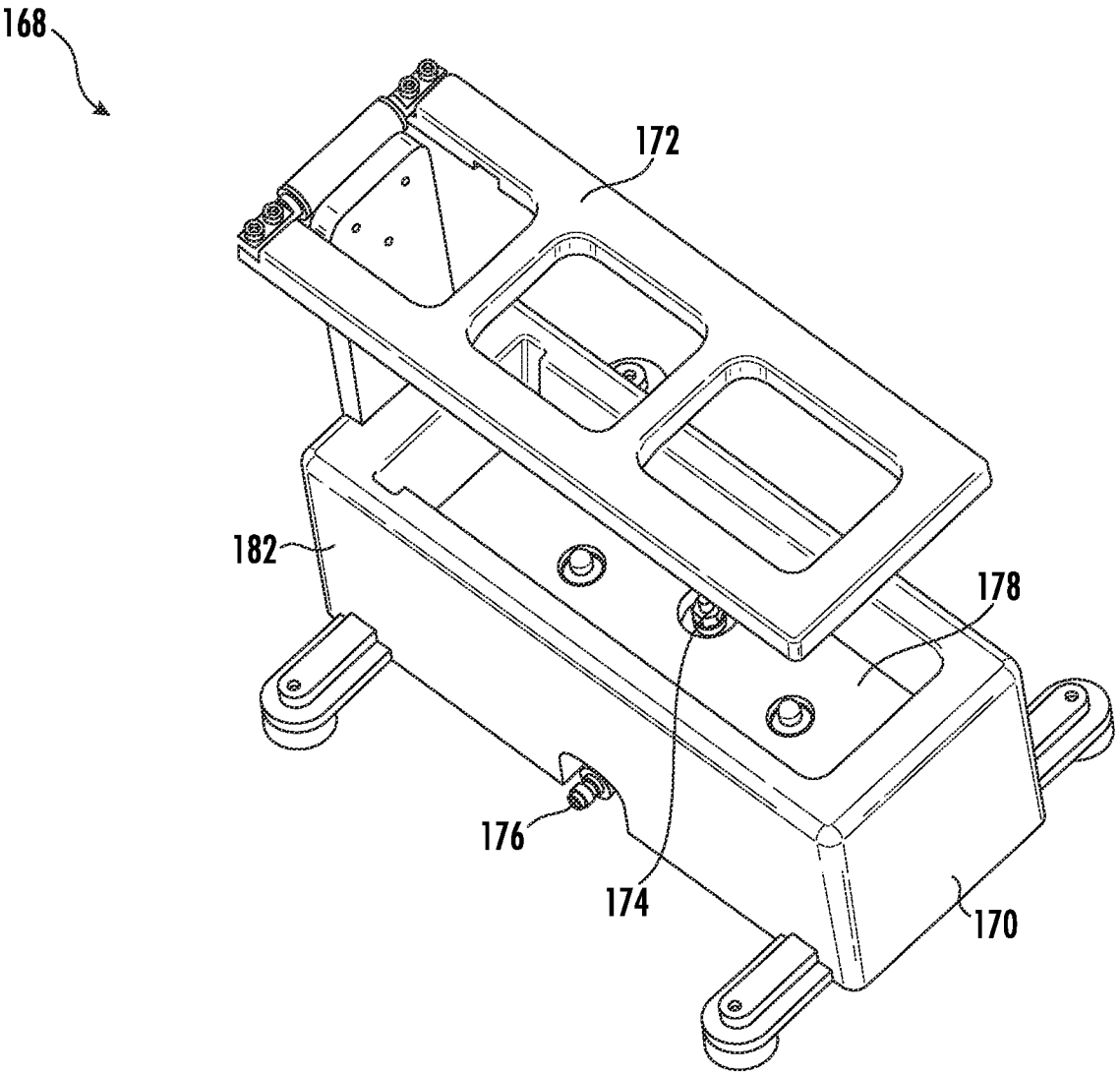
FIG. 13 is a perspective view of the HPA drum magazine refill station.
Figure 14:
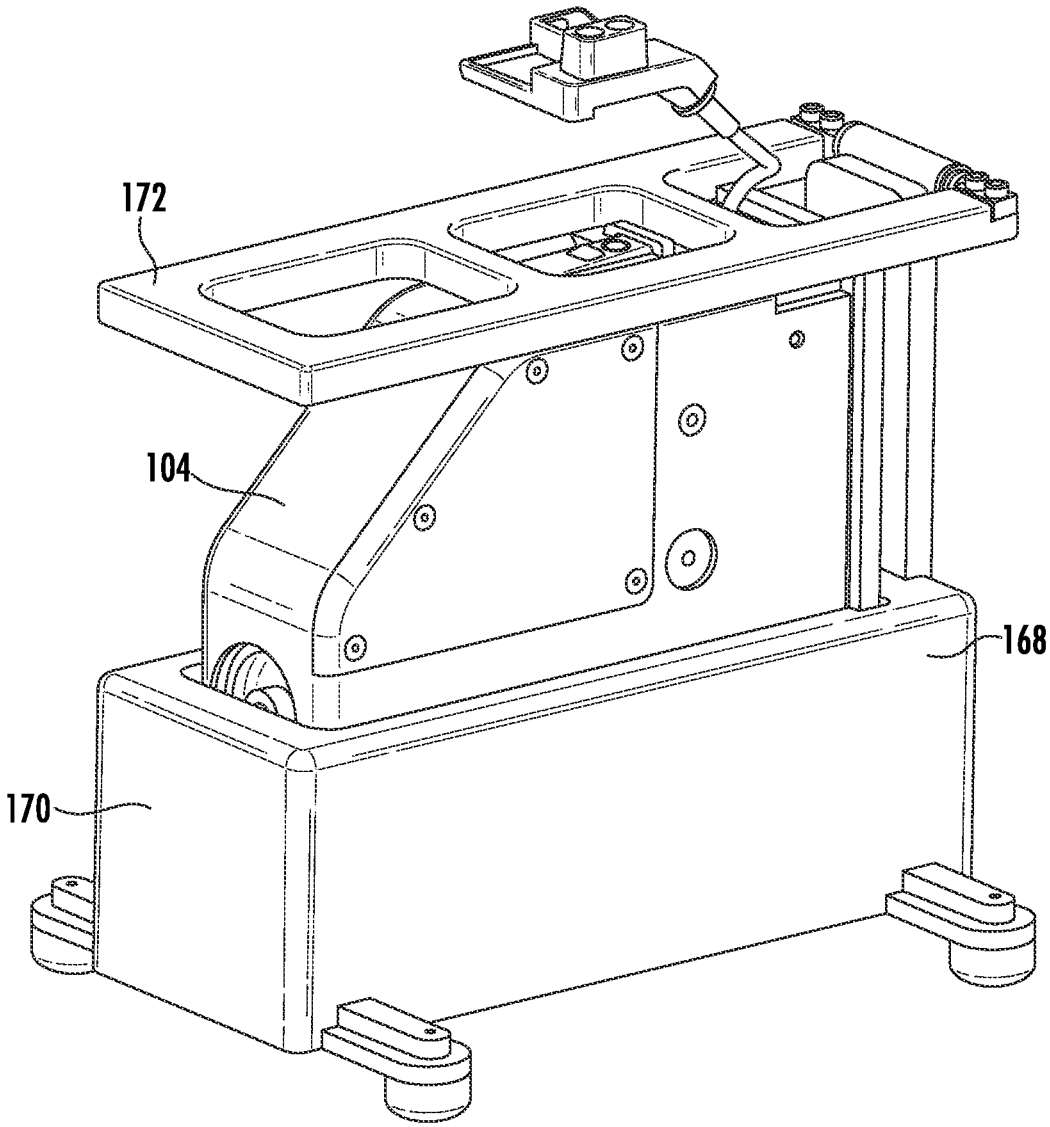
FIG. 14 is a perspective view of the HPA drum magazine shown in FIG. 5 installed in the HPA drum magazine refill station shown in FIG. 13.
Figure 15:
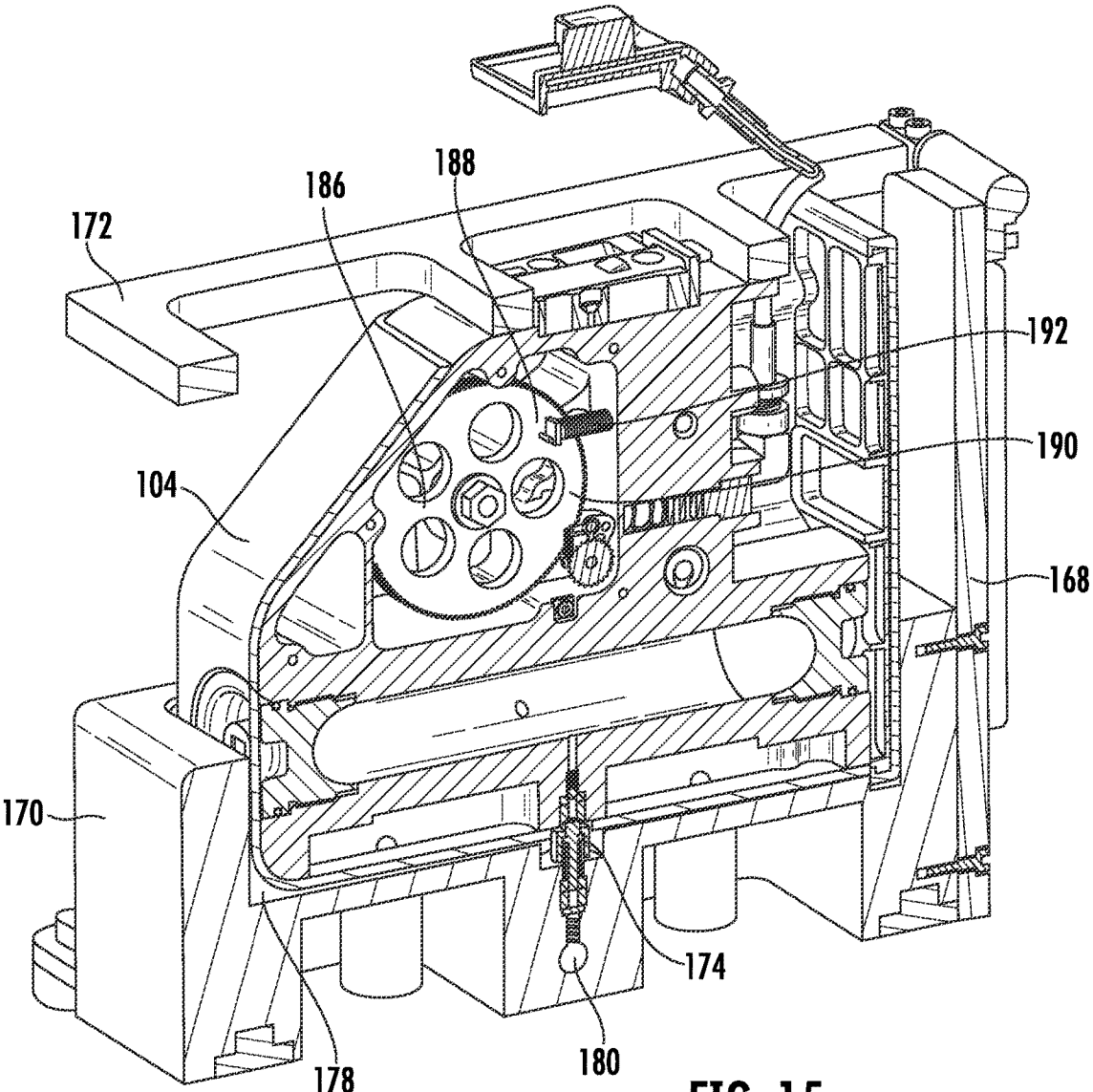
FIG. 15 is a cross section view of the HPA drum magazine and refill station shown in FIG. 14 showing the connection of the air release nipple of the refill station with the fill port of the HPA drum magazine.
Figure 16:
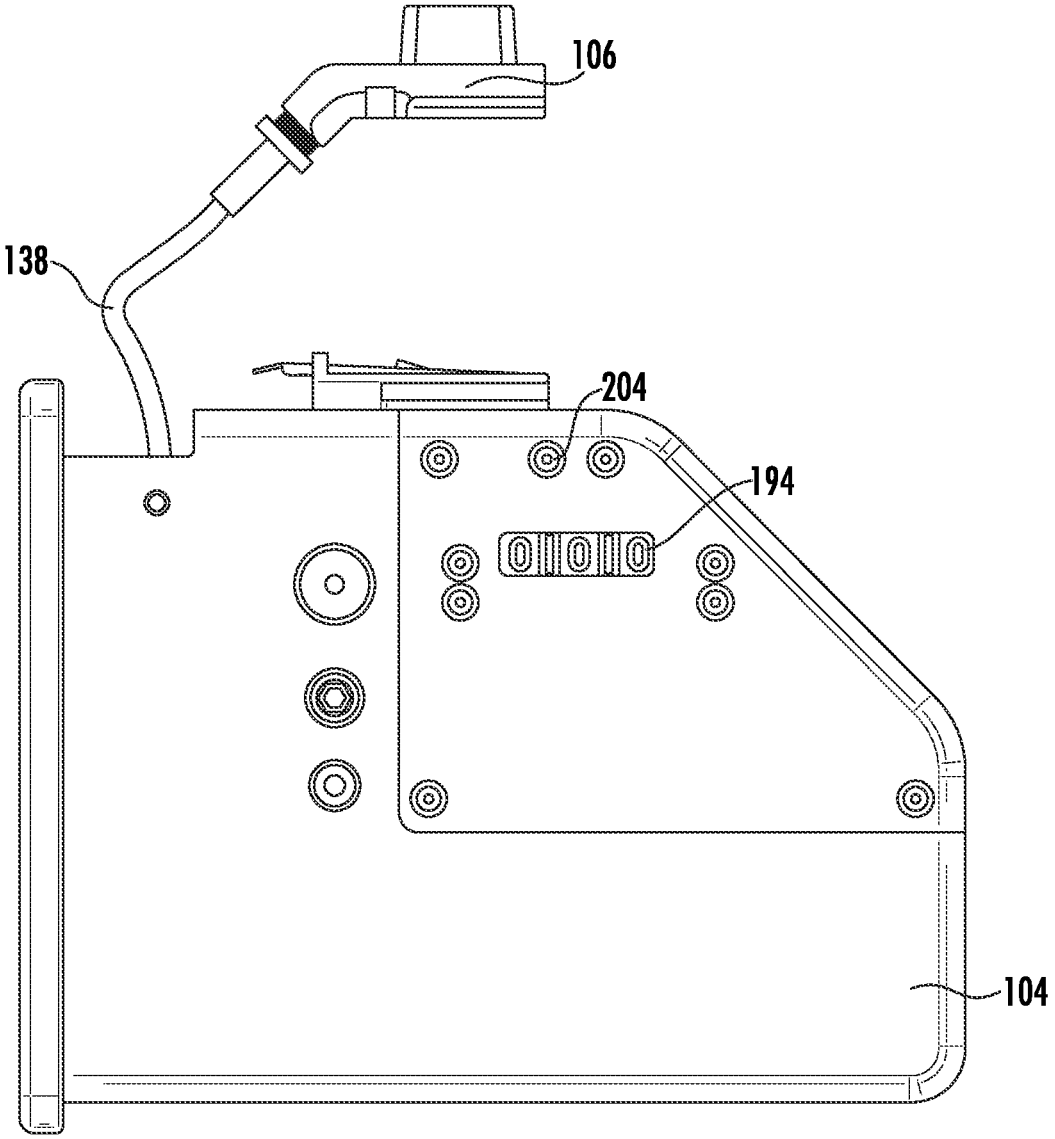
FIG. 16 is a front view of an HPA drum magazine with a display counter.
Figure 17:
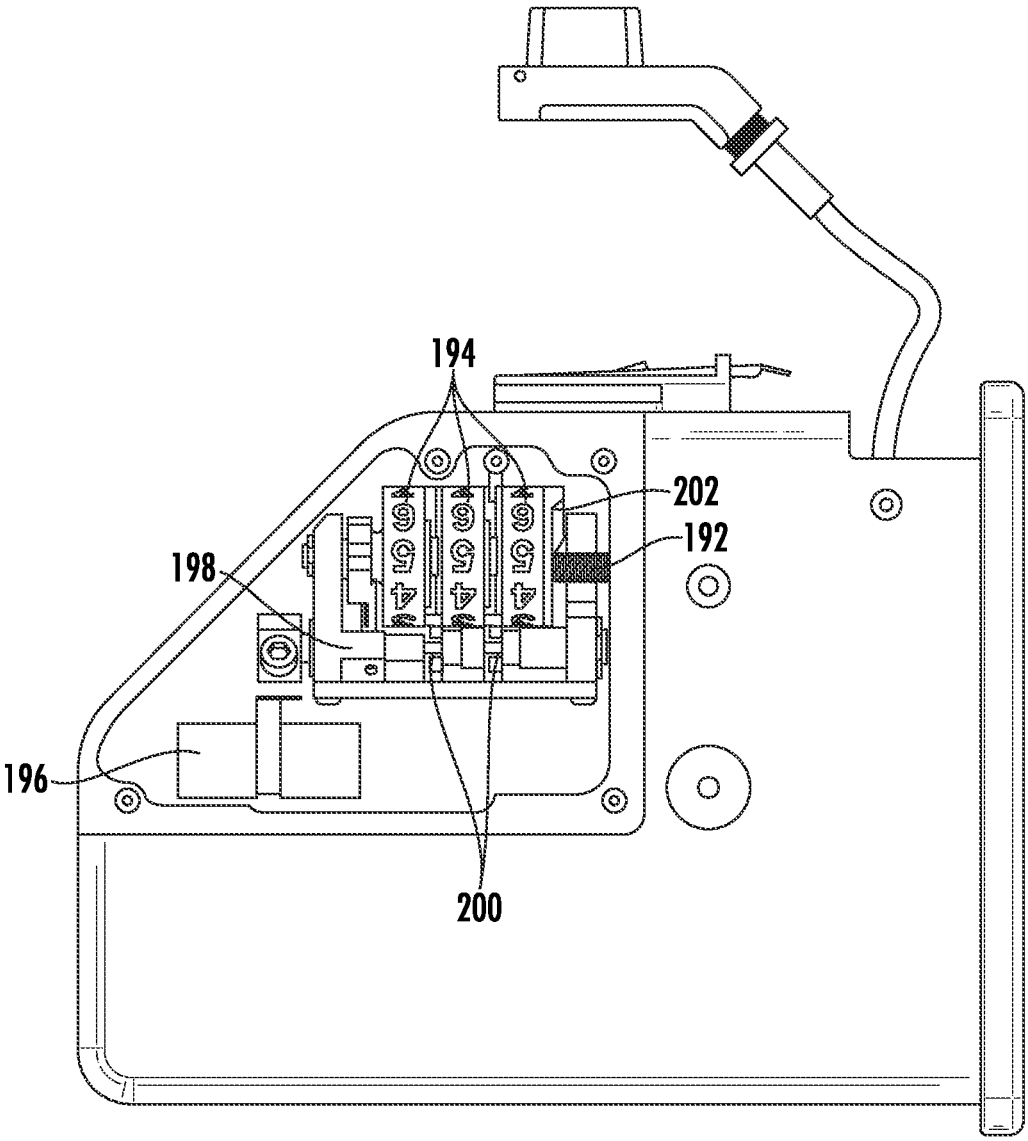
FIG. 17 is a back view of the HPA drum magazine shown in FIG. 16 with a portion of the outer housing removed to show the internal structure of the display counter.
Figure 18:
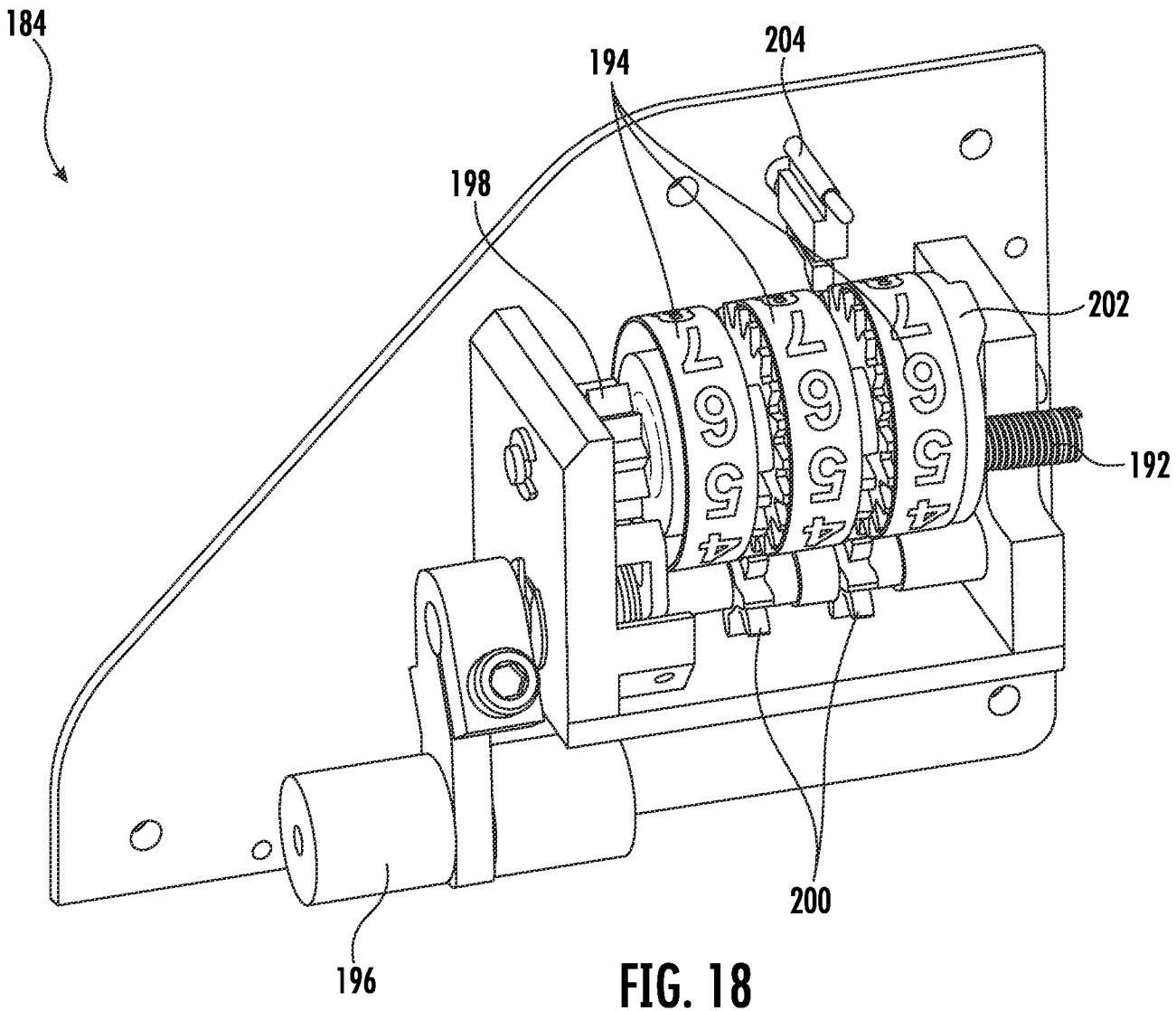
FIG. 18 is a back close-up view of the internal structure of the display counter shown in FIG. 17.
Figure 19:
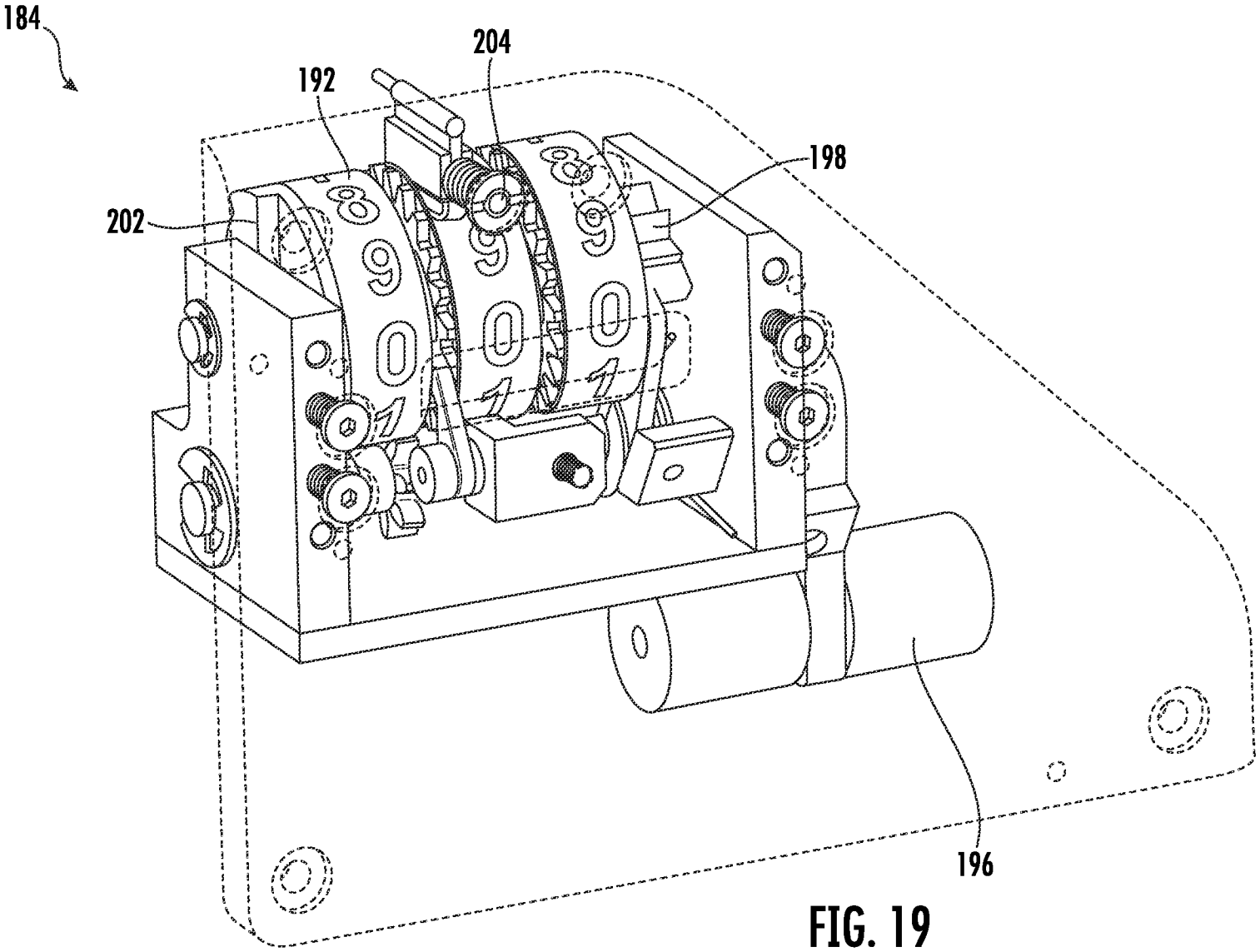
FIG. 19 is a front close-up view of the internal structure of the display counter shown in FIG. 17.
Figure 20:
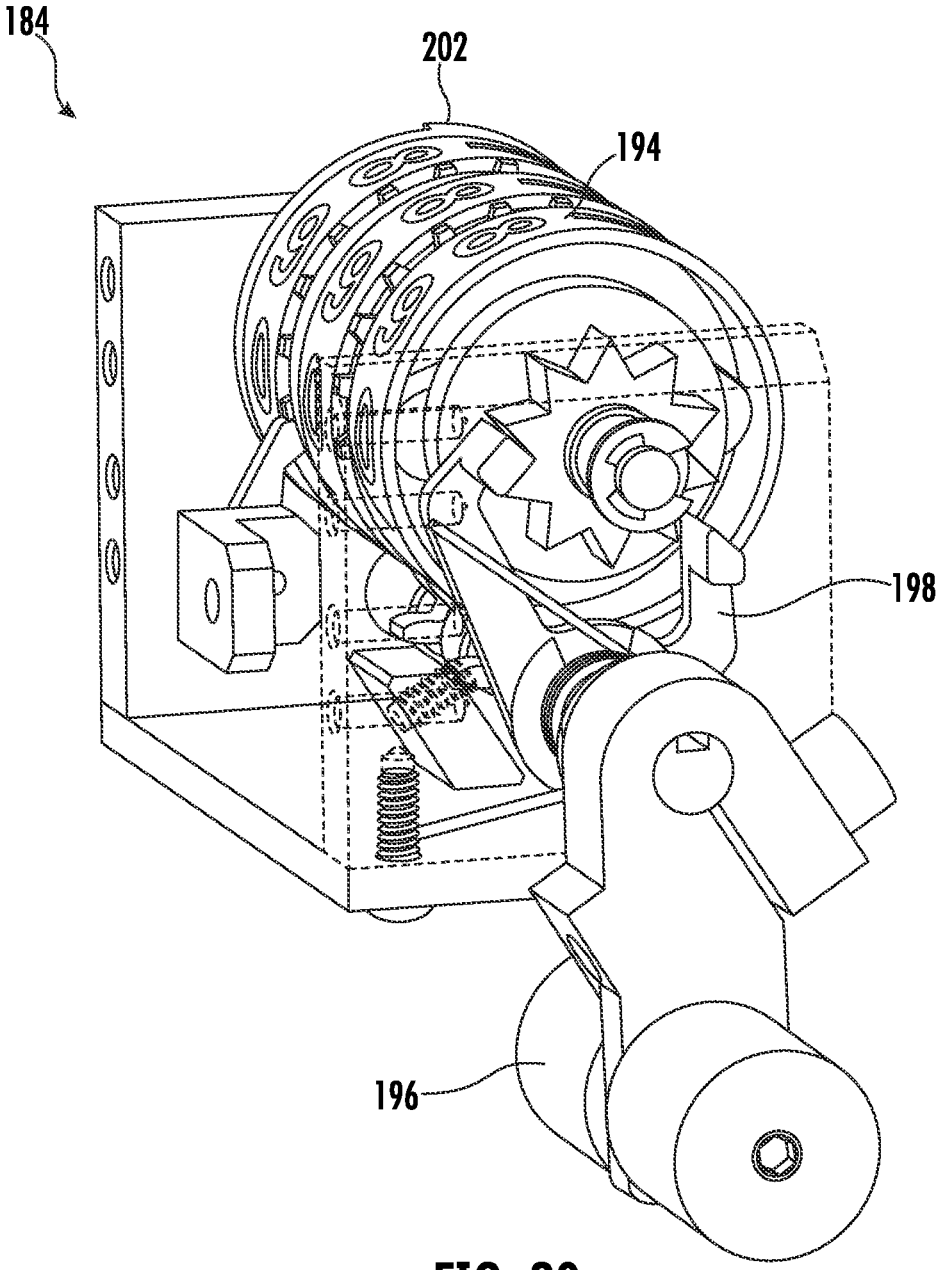
FIG. 20 is a side close-up view of the internal structure of the display counter shown in FIG. 17.

FIGS. 13-15 show a high-pressure air drum magazine refill station 168. The refill station 168 may comprise a station base 170, a pressure arm 172, an air release nipple 174, and a high-pressure air receiver 176. The station base 170 may comprise a recess 178 configured to receive the high-pressure air drum magazine 104 seated within the recess 178. The pressure arm 172 may be pivotally coupled to the station base 170 and may be moveable between a raised position and a lowered position. When the pressure arm 172 is in the lowered position, the pressure arm 172 is configured to secure the high-pressure air drum magazine 104 within the recess 178 such that the high-pressure air drum magazine 104 is entrapped within the recess 178 until the pressure arm 172 is moved to the raised position. The air release nipple 174 is positioned within the recess 178 and is communicatively coupled to a high-pressure air passage 180 (see FIG. 15) through the station base 170. The high-pressure air receiver 176 is positioned on a side 182 of the station base 170 and is communicatively coupled to the high-pressure air passage 180. Similar to the fill port 134, the high-pressure air receiver 176 is configured to couple with a high-pressure nozzle to fill the high-pressure chamber 130 with pressurized air. Thus, when a high-pressure air drum magazine 104 is seated within the recess 178 and high-pressure air receiver 176 is coupled to a high-pressure nozzle, the high-pressure chamber 130 can be filled with pressurized air through the refill station 168. The refill station 168 helps to stabilize the high-pressure air drum magazine 104 while filling the high-pressure air drum magazine 104 with pressurized air.

As illustrated in FIGS. 15-20, the high-pressure air drum magazine 104 may also comprise a counter 184 configured to track a number of times the weapon 10 is activated. The counter 184 allows the high-pressure air drum magazine 104 to behave like a conventional drum magazine that runs out of rounds. For example, a conventional drum magazine for a belt-fed weapon may have capacity for 200 rounds, and, after 200 shots, locks out and must be refilled or replaced. The counter 184 allows the high-pressure air drum magazine 104 to lock out after a predetermined number of shots. Thus, in some embodiments, when the number of bursts counted by the counter 184 reaches a predetermined level, the high-pressure air drum magazine 104 may lock out and restrict airflow out of the high-pressure air drum magazine 104. Alternatively, the high-pressure air drum magazine 104 may be configured to vent any remaining air within the high-pressure air drum magazine 104 until the pressure within the high-pressure air drum magazine 104 reaches atmospheric pressure. To continue activating the weapon 10, the trainee would need to detach the high-pressure air drum magazine 104 from the weapon 10 and replace it with a high-pressure air drum magazine 104 that has not been completely discharged or that has been refilled. Once the high-pressure chamber 130 is refilled with pressurized air through the fill valve 134, the counter 184 may be reset and the high-pressure air drum magazine 104 may be reused.

The counter 184 may have a counting wheel 186 with an indexing pin 188 extending from a side 190 of the counting wheel 186, as shown in FIG. 15. The counting wheel 186 is configured to rotate with each activation of the weapon 10. Once the predetermined number of shots has been reached, the indexing pin 188 engages with a release pin 192 and triggers the release of any remaining air in the high-pressure air drum magazine 104 from the high-pressure air drum magazine 104. The counter 184 may also be configured as a plurality of rotating number wheels 194 that visually count the number of shots or display the number of shots remaining. In such an embodiment, the counter 184 may comprise a pendulum 196, a pawl and ratchet 198, and a plurality of gears 200. The pendulum 196 is configured to swing with the motion of the weapon 10 upon activation. This motion oscillates the pawl and ratchet 198, which in turn rotates the gears 200. Each gear 200 acts as an intermittent Geneva mechanism for the adjacent gear 200, allowing the number wheels 194 to discretely rotate to count the number of shots. A cam plate 202 may be coupled to the last gear of the plurality of gears 200. The cam plate 202 is configured to engage with the release pin 192 once the predetermined number of shots has been reached. As disclosed above, depressing the release pin 192 vents the remaining air in the high-pressure air drum magazine 104 from the high-pressure air drum magazine 104. The counter 184 may also have a counter reset button 204 on a side of the high-pressure air drum magazine 104 configured to reset the number wheels 194 to the predetermined number of shots.

Figure 7:
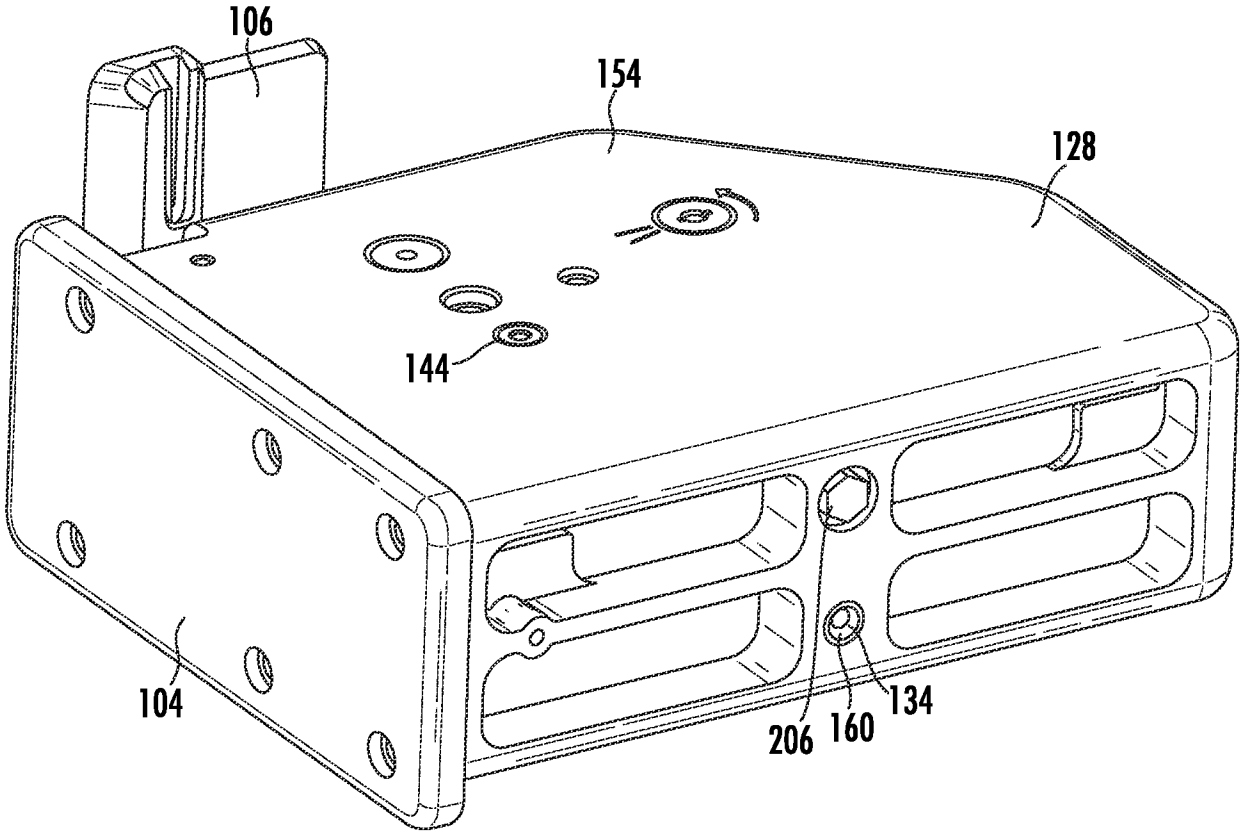
FIG. 7 is a bottom perspective view of the HPA drum magazine shown in FIG. 5, showing the burst disk and fill port.

The high-pressure air drum magazine 104 may also comprise a burst disk 206 disposed between the high-pressure chamber 130 and the surface 154 of the outer housing 128, as shown in FIGS. 6-7. The burst disk 206 is a safety feature for the high-pressure air drum magazine 104. Because high pressures are used in the high-pressure air drum magazine 104, the high-pressure air drum magazine 104 may rupture, destroying the high-pressure air drum magazine 104 and possibly causing injury to the user. The burst disk 206 is configured to fail when the pressure within the high-pressure chamber 130 reaches a predetermined maximum pressure and allow air to exit from the high-pressure chamber 130. Thus, dangerous levels of pressure within the high-pressure chamber 130 may be avoided.

The weapon 10 often has a defined rate of fire that must be maintained in order to simulate live fire conditions. The speed and air flow rate of the air regulator 136 is critical to achieve the desired rate of fire. Orifices which connect the high-pressure chamber 130, the air regulator 136, the low-pressure chamber 132, and the air passage 138 are a critical part of allowing enough air flow. If the orifice is too small, or has imperfections (like burrs), the low-pressure chamber 132 cannot be replenished fast enough. If this happens, the timing of the weapon 10 will be off, creating a malfunction. It is also the flow and pressure combined which create a strong recoil force. By adjusting the orifice diameters, the cycle rate of the weapon 10 into which the high-pressure air drum magazine 104 is installed can be adjusted. For example, a wider air passage refills the low-pressure chamber 132 faster, thus allowing the weapon 10 to fire sooner. Conversely, a narrower air passage refills the low-pressure chamber 132 slower, slowing the cycle rate. In this way, the high-pressure air drum magazine 104 can be customized to match the firing cycle rate for the specific weapon 10 for which it is designed to achieve a more realistic training experience.

It will be understood that implementations of a high-pressure air drum magazine are not limited to the specific assemblies, devices and components disclosed in this document, as virtually any assemblies, devices and components consistent with the intended operation of a high-pressure air drum magazine may be used. Accordingly, for example, although particular high-pressure air drum magazines, and other assemblies, devices and components are disclosed, such may include any shape, size, style, type, model, version, class, measurement, concentration, material, weight, quantity, and/or the like consistent with the intended operation of high-pressure air drum magazines. Implementations are not limited to uses of any specific assemblies, devices and components; provided that the assemblies, devices and components selected are consistent with the intended operation of a high-pressure air drum magazine.

Accordingly, the components defining any high-pressure air drum magazine may be formed of any of many different types of materials or combinations thereof that can readily be formed into shaped objects provided that the materials selected are consistent with the intended operation of a high-pressure air drum magazine. For example, the components may be formed of: polymers such as thermoplastics (such as ABS, Fluoropolymers, Polyacetal, Polyamide; Polycarbonate, Polyethylene, Polysulfone, and/or the like), thermosets (such as Epoxy, Phenolic Resin, Polyimide, Polyurethane, Silicone, and/or the like), any combination thereof, and/or other like materials; glasses (such as quartz glass), carbon-fiber, aramid-fiber, any combination thereof, and/or other like materials; composites and/or other like materials; metals, such as zinc, magnesium, titanium, copper, lead, iron, steel, carbon steel, alloy steel, tool steel, stainless steel, brass, nickel, tin, antimony, pure aluminum, 1100 aluminum, aluminum alloy, any combination thereof, and/or other like materials; alloys, such as aluminum alloy, titanium alloy, magnesium alloy, copper alloy, any combination thereof, and/or other like materials; any other suitable material; and/or any combination of the foregoing thereof. In instances where a part, component, feature, or element is governed by a standard, rule, code, or other requirement, the part may be made in accordance with, and to comply under such standard, rule, code, or other requirement.

Various high-pressure air drum magazines may be manufactured using conventional procedures as added to and improved upon through the procedures described here. Some components defining a high-pressure air drum magazine may be manufactured simultaneously and integrally joined with one another, while other components may be purchased pre-manufactured or manufactured separately and then assembled with the integral components. Various implementations may be manufactured using conventional procedures as added to and improved upon through the procedures described here.

Accordingly, manufacture of these components separately or simultaneously may involve extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled with one another in any manner, such as with adhesive, a weld, a fastener (e.g. a bolt, a nut, a screw, a nail, a rivet, a pin, and/or the like), wiring, any combination thereof, and/or the like for example, depending on, among other considerations, the particular material forming the components.

It will be understood that methods for manufacturing or assembling high-pressure air drum magazines are not limited to the specific order of steps as disclosed in this document. Any steps or sequence of steps of the assembly of a high-pressure air drum magazine indicated herein are given as examples of possible steps or sequence of steps and not as limitations, since various assembly processes and sequences of steps may be used to assemble high-pressure air drum magazines.

The implementations of a high-pressure air drum magazine described are by way of example or explanation and not by way of limitation. Rather, any description relating to the foregoing is for the exemplary purposes of this disclosure, and implementations may also be used with similar results for a variety of other applications employing a high-pressure air drum magazine.

What is claimed is:

1. A tether-less, air-pressured recoil kit for a weapon having a trigger, the recoil kit comprising:

a receiver insert configured for attachment to a receiver of a belt-fed weapon, the receiver insert comprising:

a charge chamber comprising a biased plunger extending through a rear end of the charge chamber and an air-receiving nipple on a side of the charge chamber configured to receive air into the charge chamber, the biased plunger biased rearward toward the rear end and moveable between a forward position and a rearward position; and a bolt carrier configured to respond to the trigger being activated on the weapon to move the plunger from its rearward position toward its forward position;

an air connector plate comprising a seal and configured to sealingly engage with the air-receiving nipple of the charge chamber and become locked in place between the charge chamber and a feed cover of the weapon when the feed cover is locked in a closed position; and a high-pressure air drum magazine comprising:

an outer housing formed of aluminum and configured to connect to a bottom side of the weapon, the high-pressure air drum magazine coupled through a flexible air passage to the air connector plate;

a high-pressure chamber formed within the outer housing and sized to hold a predetermined quantity of pressurized air;

a chamber plug sealingly coupled to a first end of the high-pressure air chamber;

a fill valve disposed between the high-pressure chamber and a fill port exposed on a surface of the outer housing, the fill port configured to couple with a high-pressure nozzle to admit pressurized air into the high-pressure chamber;

an air regulator communicatively coupled to the high-pressure chamber within the outer housing and configured to selectively pass air from the high-pressure chamber through a low-pressure chamber within the outer housing and to the air connector plate, the air regulator comprising:

a regulator ball valve positioned between the high-pressure chamber and the low-pressure chamber, the regulator ball valve biased by a compression spring to a closed position wherein airflow from the high-pressure chamber to the low-pressure chamber is minimized;

a regulator valve screw exposed on the surface of the outer housing and configured to adjust a magnitude of a bias on the regulator ball valve created by the compression spring;

a regulator piston exposed to the low-pressure chamber and in contact with the regulator ball valve, wherein when a pressure within the low-pressure chamber lowers past a predetermined pressure, the regulator piston is biased by a primary regulator spring to push the regulator ball valve from the closed position to an open position wherein air flows from the high-pressure chamber to the low-pressure chamber until the pressure within the low-pressure chamber reaches the predetermined pressure; and a regulator piston support nut exposed on the surface of the outer housing and configured to adjust the predetermined pressure by adjusting the magnitude of the bias on the regulator piston created by the primary regulator spring; and a counter configured to track a number of bursts of air released through the air connector plate;

wherein when the bolt carrier impacts the plunger, a burst of air is released from the air connector plate into the charge chamber to force the plunger rearward and reset the bolt carrier.

2. The recoil kit of claim 1, wherein the counter comprises an indexing pin that extends from a side of a counting wheel as the counting wheel rotates until it engages with a release pin within the high-pressure air drum magazine and triggers release of any remaining air in the high-pressure air drum magazine from the high-pressure air drum magazine.

3. The recoil kit of claim 1, wherein the high-pressure air drum magazine is sized, weighted and shaped to approximate the size, weight and shape of a drum magazine of an M249 rifle carrying 200 rounds of 5.56×45 mm ammunition cartridges.

4. The recoil kit of claim 1, wherein the regulator piston of the air regulator further comprises a piston pin that rides within a sleeve of the regulator piston support nut, the sleeve being positioned within an inside diameter of the primary regulator spring and within a length of the primary regulator spring.

5. The recoil kit of claim 1, wherein the counter comprises:

a pendulum configured to swing upon activation of the trigger;

a pawl and ratchet rotatably coupled to the pendulum and configured to oscillate with the pendulum;

a plurality of gears operably coupled to the pawl and ratchet, wherein each gear of the plurality of gears is configured as a Geneva mechanism for an adjacent gear and each gear corresponds to a number wheel displaying a number related to the number of bursts of air; and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine.

6. The recoil kit of claim 1, further comprising a counter reset button on a side of the high-pressure air drum magazine.

7. The recoil kit of claim 1, further comprising an electronic shot monitoring system coupled to the receiver and configured to extend from the receiver into a barrel of the weapon and transmit a signal when the recoil kit is activated.

8. The recoil kit of claim 1, further comprising a high-pressure air drum magazine refill station comprising:

a station base comprising a recess configured to receive the high-pressure air drum magazine seated within the recess;

a pressure arm pivotally coupled to the station base and moveable between a raised position and a lowered position, wherein when in the lowered position the pressure arm is configured to secure the high-pressure air drum magazine within the recess;

an air release nipple within the recess, the air release nipple communicatively coupled to a high-pressure air passage through the station base; and a high-pressure air receiver on a side of the station base communicatively coupled to the high-pressure air passage;

wherein administration of high-pressure air to the high-pressure air receiver when the high-pressure air drum magazine is seated within the recess and the pressure arm is in its lowered position results in the high-pressure air drum magazine being refilled.

9. A tether-less, air-pressured recoil kit for a weapon having a trigger, the recoil kit comprising:

a receiver insert configured for attachment to a receiver of a belt-fed weapon, the receiver insert comprising:

a charge chamber comprising a biased plunger extending through a rear end of the charge chamber and an air-receiving nipple on a side of the charge chamber configured to receive air into the charge chamber, the biased plunger biased rearward toward the rear end and moveable between a forward position and a rearward position; and a bolt carrier configured to respond to weapon activation and force the plunger toward its forward position;

an air connector plate configured to engage with the air-receiving nipple of the charge chamber when a feed cover of the weapon is in a closed position; and a high-pressure air drum magazine comprising:

an outer housing configured to connect to the weapon, the high-pressure air drum magazine in fluid communication with the air connector plate through a flexible air passage;

a high-pressure chamber within the outer housing and sized to hold a predetermined quantity of pressurized air;

a fill valve accessible from a surface of the outer housing;

an air regulator communicatively coupled to the high-pressure chamber within the outer housing and configured to selectively pass air from the high-pressure chamber through the flexible air passage to the air connector plate, the air regulator comprising:

a regulator valve positioned between the high-pressure chamber and a low-pressure chamber, the regulator valve biased to a closed position; and a regulator piston exposed to the low-pressure chamber and in contact with the regulator valve, wherein the regulator piston is biased to push the regulator valve from the closed position to an open position until the pressure within the low-pressure chamber reaches the predetermined pressure; and a counter configured to track a number of bursts of air released through the air connector plate;

wherein when the bolt carrier impacts the plunger, one burst of air from the number of bursts of air is released from the air connector plate into the charge chamber.

10. The recoil kit of claim 9, wherein the air regulator further comprising a regulator valve screw accessible at the surface of the outer housing and configured to adjust a magnitude of a bias on the regulator valve.

11. The recoil kit of claim 10, further comprising a regulator piston support nut exposed on the surface of the outer housing and configured to adjust the predetermined pressure by adjusting a magnitude of a bias on the regulator piston.

12. The recoil kit of claim 9, wherein the high-pressure air drum magazine is sized, weighted and shaped to approximate the size, weight and shape of a drum magazine of an M249 rifle carrying 200 rounds of 5.56×45 mm ammunition cartridges.

13. The recoil kit of claim 9, further comprising a high-pressure air drum magazine refill station comprising:

a station base comprising a recess configured to receive the high-pressure air drum magazine seated within the recess;

a pressure arm pivotally coupled to the station base and moveable between a raised position and a lowered position, wherein when in the lowered position the pressure arm is configured to secure the high-pressure air drum magazine within the recess;

an air release nipple within the recess, the air release nipple communicatively coupled to a high-pressure air passage through the station base; and a high-pressure air receiver on a side of the station base communicatively coupled to the high-pressure air passage;

wherein administration of high-pressure air to the high-pressure air receiver when the high-pressure air drum magazine is seated within the recess and the pressure arm is in its lowered position results in the high-pressure air drum magazine being refilled.

14. The recoil kit of claim 9, wherein the counter comprises:

a pendulum configured to swing upon activation of the trigger;

a pawl and ratchet rotatably coupled to the pendulum and configured to oscillate with the pendulum;

a plurality of gears operably coupled to the pawl and ratchet, wherein each gear of the plurality of gears is configured as a Geneva mechanism for an adjacent gear and each gear corresponds to a number wheel displaying a number related to the number of bursts of air; and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine.

15. A tether-less, air-pressured recoil kit for a weapon having a trigger, the recoil kit comprising: a receiver insert configured for attachment to a receiver of the weapon, the receiver insert comprising: a charge chamber comprising a plunger extending through a rear end of the charge chamber and moveable between a forward position and a rearward position; and a bolt carrier configured to respond to weapon activation and force the plunger toward its forward position; an air connector plate configured to engage with the charge chamber; and a high-pressure air drum magazine comprising: an outer housing and in fluid communication with the air connector plate through an air passage; a high-pressure chamber within the outer housing; and an air regulator communicatively coupled to the high-pressure chamber and configured to selectively pass air from the high-pressure chamber to the air connector plate; wherein when the bolt carrier impacts the plunger, a burst of air is released from the air connector plate into the charge chamber; wherein the recoil kit further comprises a high-pressure air drum magazine refill station comprising: a station base comprising a recess configured to receive the high-pressure air drum magazine seated within the recess; a pressure arm pivotally coupled to the station base and moveable between a raised position and a lowered position, wherein when in the lowered position the pressure arm is configured to secure the high-pressure air drum magazine within the recess; an air release nipple within the recess, the air release nipple communicatively coupled to a high-pressure air passage through the station base; and a high-pressure air receiver on a side of the station base communicatively coupled to the high-pressure air passage; wherein administration of high-pressure air to the high-pressure air receiver when the high-pressure air drum magazine is seated within the recess and the pressure arm is in its lowered position results in the high-pressure air drum magazine being refilled.

16. The recoil kit of claim 15, the air regulator further comprising:

a regulator valve positioned between the high-pressure chamber and a low-pressure chamber, the regulator valve biased to a closed position;

a regulator valve screw exposed on a surface of the outer housing and configured to adjust a magnitude of a bias on the regulator valve;

a regulator piston exposed to the low-pressure chamber and in contact with the regulator valve, wherein when a pressure within the low-pressure chamber lowers past a predetermined pressure, the regulator piston is biased to push the regulator valve from the closed position to an open position wherein air flows from the high-pressure chamber to the low-pressure chamber until the pressure within the low-pressure chamber reaches the predetermined pressure; and a regulator piston support nut exposed on the surface of the outer housing and configured to adjust the predetermined pressure by adjusting the magnitude of the bias on the regulator piston.

17. The recoil kit of claim 15, further comprising a counter within the outer housing and configured to track a number of bursts of air released through the air connector plate.

18. The recoil kit of claim 17, wherein the counter comprises:

a pendulum configured to swing upon activation of the trigger;

a pawl and ratchet rotatably coupled to the pendulum and configured to oscillate with the pendulum;

a plurality of gears operably coupled to the pawl and ratchet, wherein each gear of the plurality of gears is configured as a Geneva mechanism for an adjacent gear and each gear corresponds to a number wheel displaying a number related to the number of bursts of air; and a cam plate coupled to a last gear of the plurality of gears and configured to engage with a release pin, wherein when the cam plate engages with the release pin, the release pin triggers release of any remaining air in the high-pressure air drum magazine from the high-pressure air drum magazine.

19. The recoil kit of claim 15, wherein the high-pressure air drum magazine is sized, weighted and shaped to approximate the size, weight and shape of a drum magazine of an M249 rifle carrying 200 rounds of 5.56×45 mm ammunition cartridges.

* * * * *